US010411327B2

(12) United States Patent
Kim et al.

(10) Patent No.: US 10,411,327 B2
(45) Date of Patent: Sep. 10, 2019

(54) ANTENNA DEVICE AND ELECTRONIC DEVICE INCLUDING SAME

(71) Applicant: Samsung Electronics Co., Ltd., Gyeonggi-do (KR)

(72) Inventors: Ji-Won Kim, Gyeonggi-do (KR); Jinu Kim, Seoul (KR); Hui-Won Cho, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 518 days.

(21) Appl. No.: 15/056,638

(22) Filed: Feb. 29, 2016

(65) Prior Publication Data

US 2016/0254588 A1 Sep. 1, 2016

(30) Foreign Application Priority Data

Feb. 27, 2015 (KR) ..... 10-2015-0028340

(51) Int. Cl.
*H01Q 1/24* (2006.01)
*H01Q 1/38* (2006.01)

(52) U.S. Cl.
CPC ..... *H01Q 1/24* (2013.01); *H01Q 1/243* (2013.01); *H01Q 1/38* (2013.01)

(58) Field of Classification Search
CPC ..... H01Q 1/243
(Continued)

(56) References Cited

U.S. PATENT DOCUMENTS 8,188,930 B2 5/2012 Sung et al.
8,711,044 B2 4/2014 Arkko et al.
(Continued)

FOREIGN PATENT DOCUMENTS

CN 102469184 5/2012
CN 102751563 10/2012
(Continued)

OTHER PUBLICATIONS

European Search Report dated Oct. 20, 2016 issued in counterpart application No. 16157846.3-1811, 7 pages.
(Continued)

*Primary Examiner* — Daniel Munoz
(74) *Attorney, Agent, or Firm* — The Farrell Law Firm, P.C.

(57) ABSTRACT

An electronic device and an antenna device are provided herein. An electronic device includes a conductive sidewall; a conductive structure located within a space formed by the conductive sidewall and extending from the conductive sidewall, wherein the conductive structure includes a first surface directed toward a front of the portable electronic device and a second surface directed toward a back of the portable electronic device; a non-conductive structure located within the space formed by the conductive sidewall and contacting the conductive structure, wherein the non-conductive structure includes a first surface directed toward the front of the portable electronic device and a second surface directed toward the back of the portable electronic device; an antenna pattern electrically connected to the conductive structure; and a flexible conductive connector electrically connected to the conductive structure and the antenna pattern. The antenna pattern extends on a portion of the first surface of the conductive structure and on a portion of the first surface of the non-conductive structure, or extends on a portion of the second surface of the conductive structure and on a portion of the second surface of the non-conductive structure.

19 Claims, 39 Drawing Sheets

(58) Field of Classification Search
USPC ..... 343/702
See application file for complete search history.

(56) References Cited

U.S. PATENT DOCUMENTS

| | | | | |
|---|---|---|---|---|
| 10,069,192 | B2 | 9/2018 | Tsou et al. | |
| 2010/0060529 | A1* | 3/2010 | Schlub | H01Q 1/243 343/702 |
| 2012/0105287 | A1 | 5/2012 | Jung et al. | |
| 2012/0176278 | A1 | 7/2012 | Merz et al. | |
| 2012/0176279 | A1* | 7/2012 | Merz | H01Q 1/243 343/702 |
| 2013/0063314 | A1 | 3/2013 | Whitmore | |
| 2013/0249744 | A1 | 9/2013 | Jang et al. | |
| 2014/0038533 | A1 | 2/2014 | Zhuang et al. | |
| 2014/0111684 | A1 | 4/2014 | Corbin et al. | |
| 2014/0228080 | A1 | 8/2014 | Choi et al. | |
| 2014/0285386 | A1 | 9/2014 | Merz et al. | |
| 2014/0313086 | A1 | 10/2014 | Montevirgen et al. | |
| 2014/0368228 | A1 | 12/2014 | Kim | |
| 2015/0048979 | A1 | 2/2015 | Asrani et al. | |
| 2017/0322480 | A1* | 11/2017 | Kanemaki | G03B 17/08 |

FOREIGN PATENT DOCUMENTS

| | | |
|---|---|---|
| CN | 103138042 | 6/2013 |
| EP | 2 618 423 | 7/2013 |
| KR | 10-2011-0080630 | 7/2011 |
| KR | 10-1054579 | 7/2011 |
| KR | 10-2013-0014784 | 2/2013 |
| KR | 10-1381135 | 3/2014 |
| KR | 10-2014-0101240 | 8/2014 |

OTHER PUBLICATIONS

International Search Report dated Jun. 16, 2016 issued in counterpart application No. PCT/KR2016/001977, 8 pages.
Chinese Office Action dated Jan. 30, 2019 issued in counterpart application No. 201680008206.6, 12 pages.
Indian Office Action dated May 9, 2019 issued in counterpart application No. 201717025325, 6 pages.

* cited by examiner

ANTENNA DEVICE AND ELECTRONIC DEVICE INCLUDING SAME

PRIORITY

This application claims priority under 35 U.S.C. § 119(a) to Korean Application Serial No. 10-2015-0028340, which was filed in the Korean Intellectual Property Office on Feb. 27, 2015, the entire content of which is incorporated herein by reference.

BACKGROUND

1. Field of the Disclosure

Various embodiments of the present disclosure relate to an electronic device and, for example, to an electronic device including an antenna device.

2. Description of the Related Art

Slim electronic device design generally concerns efficiently arranging a space for at least one antenna device for communication, preventing degradation in radiation performance, and achieving excellent performance.

Commonly, an antenna device used in an electronic device has an Inverted-F Antenna (IFA) or a monopole radiator as a basic structure, and the volume and the number of antenna radiators to be mounted therein may be determined based on the frequency, bandwidth, and the type of service provided by the electronic device. For example, antenna devices should satisfy wireless communication services performed in various bands, such as Global System for Mobile communication (GSM), Long-Term Evolution (LTE), Bluetooth (BT), global positioning system (GPS), Wi-Fi, etc.

Accordingly, a slim electronic devices should satisfy the aforementioned communication bands in the given mounting spaces of antenna radiators, have electric fields in which a Specific Absorption Rate (SAR) for determining a harmful effect to a human body is lower than a reference value, and overcome a radiation performance degradation caused by surrounding metal mechanical parts (e.g., a metal housing, a metal bezel, an electronic component using a metal material, etc.).

In recent years, an antenna radiator of an antenna device has been disposed on an antenna carrier that has a predetermined height. However, such a configuration is outdated due to the increasingly slimmer designs of electronic devices, and antenna radiators must be disposed on substrates occupying relatively smaller spaces, on outer surfaces of housings, and/or on parts of housings.

While an antenna unit may also include an antenna radiator that is disposed in a housing of an electronic device in an In-Mold type, this method is also excluded due to the volume of a molded part.

SUMMARY

Accordingly, an aspect of the present disclosure is to provide an antenna device and an electronic device including the same that minimize the aforementioned problems.

Another aspect of the present disclosure is to provide an antenna device and an electronic device including the same that can maximize antenna performance using a suitable mounting space and a degree of freedom of a pattern of the antenna device.

Another aspect of the present disclosure is to provide an antenna device and an electronic device including the same, in which an extension antenna radiator is connected in an electronic device that uses a metal member as a structure of the electronic device (e.g., a part of a housing or a structure containing a partial area that uses a side appearance of a housing of an electronic device as a metal bezel) and as an antenna device.

In accordance with an aspect of the present disclosure, a portable electronic device is provided, which includes a conductive sidewall; a conductive structure located within a space formed by the conductive sidewall and extending from the conductive sidewall, wherein the conductive structure includes a first surface directed toward a front of the portable electronic device and a second surface directed toward a back of the portable electronic device; a non-conductive structure located within the space formed by the conductive sidewall and contacting the conductive structure, wherein the non-conductive structure includes a first surface directed toward the front of the portable electronic device and a second surface directed toward the back of the portable electronic device; an antenna pattern electrically connected to the conductive structure; and a flexible conductive connector electrically connected to the conductive structure and the antenna pattern. The antenna pattern extends on a portion of the first surface of the conductive structure and on a portion of the first surface of the non-conductive structure, or extends on a portion of the second surface of the conductive structure and on a portion of the second surface of the non-conductive structure.

In accordance with another aspect of the present disclosure, a portable electronic device is provided, which includes a conductive sidewall; a first conductive structure located in a space formed by the conductive sidewall and extending from the conductive sidewall, wherein the first conductive structure includes a first surface directed toward a front of the portable electronic device and a second surface directed toward a back of the portable electronic device; a non-conductive structure located in the space formed by the conductive sidewall and contacting the first conductive structure, wherein the non-conductive structure includes a first surface directed toward the front of the portable electronic device and a second surface directed toward the back of the portable electronic device, and wherein the non-conductive structure includes a via hole formed therethrough from the first surface to the second surface; a second conductive structure including a part that passes through the via hole, a first surface directed toward the front of the portable electronic device, and a second surface directed toward the back of the portable electronic device; an antenna pattern electrically connected to the second conductive structure; and a flexible conductive connector electrically connected to the second conductive structure and the antenna pattern. The antenna pattern extends on a portion of the first surface of the second conductive structure and on a portion of the first surface of the non-conductive structure, or extends on a portion of the second surface of the second conductive structure and on a portion of the second surface of the non-conductive structure.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION OF EMBODIMENTS OF THE DISCLOSURE

Figure 1:
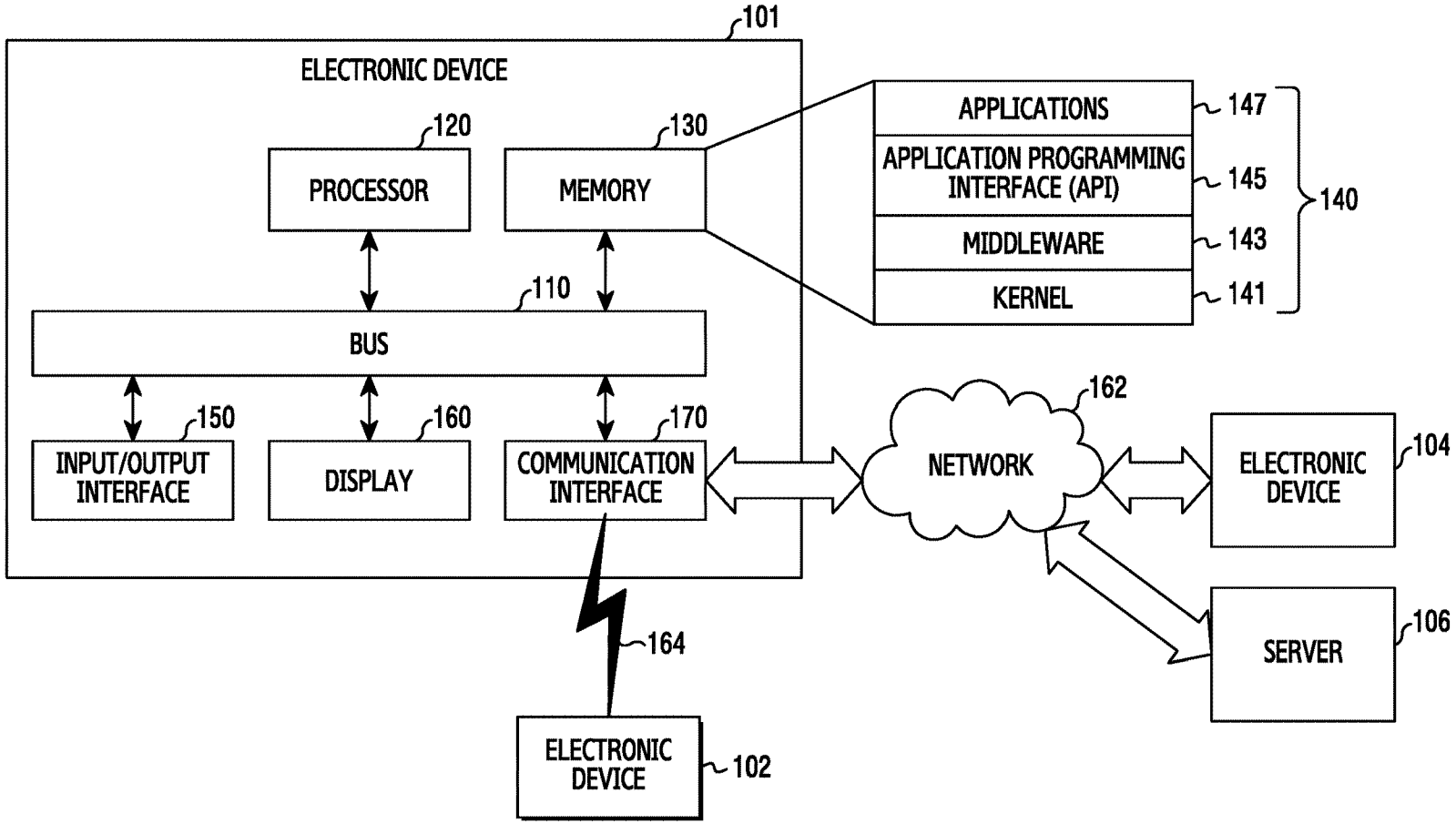
FIG. 1 illustrates a network environment that includes an electronic device according to an embodiment of the present disclosure.

The following description, with reference to the accompanying drawings, is provided to assist in a comprehensive understanding of various embodiments of the present disclosure as defined by the claims and their equivalents. The description includes various specific details to assist in that understanding, but these details are to be regarded as merely exemplary. For example, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but are used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

Herein, singular forms such as "a," "an," and "the" include plural referents unless the context clearly dictates otherwise. Thus, for example, reference to "a component surface" includes reference to one or more of such surfaces.

The term "substantially" indicates that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide.

The terms "have," "may have," "include," and "may include" indicate the presence of corresponding features, numbers, functions, parts, operations, elements, etc., but do not limit additional one or more features, numbers, functions, parts, operations, elements, etc. The terms "A or B," "at least one of A or/and B", and "one or more of A or/and B" may include any and all combinations of words enumerated with it. For example, "A or B," "at least one of A and B", and "at least one of A or B" describe (1) including A, (2) including B, or (3) including both A and B.

Although terms, such as "first" and "second" as used herein may modify various elements of various embodiments of the present disclosure, these terms do not limit the corresponding elements. For example, these terms do not limit an order and/or importance of the corresponding elements. These terms may be used for the purpose of distinguishing one element from another element. For example, a first user device and a second user device both indicate user devices and may indicate different user devices. A first element may be referred to as a second element without departing from the scope of the present disclosure, and similarly, a second element may be referred to as a first element.

When an element (e.g., a first element) is "connected to" or "(operatively or communicatively) coupled with/to" another element (e.g., a second element), the first element may be directly connected or coupled to the second element, or there may be an intervening element (e.g., a third element) between the first element and the second element. However, when the first element is "directly connected" or "directly coupled" to the second element, there is no intervening element between the first element and the second element.

The expression "configured to (or set to)" may be replaced with "suitable for," "having the capacity to," "designed to," "adapted to," "made to," or "capable of" according to the situation. The term "configured to (or set to)" does not necessarily indicate "specifically designed to" in a hardware level. Instead, the expression "an apparatus configured to . . . " may indicate that the apparatus is "capable of . . . " along with other devices or parts in a certain situation. For example, "a processor configured to (set to) perform A, B, and C" may be a dedicated processor, e.g., an embedded processor, for performing a corresponding operation, or a generic-purpose processor, e.g., a central processing unit (CPU) or an application processor (AP), capable of performing a corresponding operation by executing one or more software programs stored in a memory device.

All the terms used herein, including technical and scientific terms, should be interpreted to have the same meanings as commonly understood by those skilled in the art to which the present disclosure pertains, and should not be interpreted to have ideal or excessively formal meanings, unless explicitly defined herein.

A module or programming module may include at least one constituent element among the described constituent elements of an apparatus, or may omit some of them, or may further include additional constituent elements. Operations performed by a module, programming module, or other constituent elements may be executed in a sequential, parallel, repetitive, or heuristic manner. In addition, some of the operations may be executed in a different order or may be omitted, or other operations may be added.

Herein, an electronic device may be a smart phone, a tablet personal computer (PC), a mobile phone, a video phone, an e-book reader, a desktop PC, a laptop PC, a netbook computer, a workstation, a server, a personal digital assistant (PDA), a portable multimedia player (PMP), a moving picture experts group phase 1 or phase 2 (MPEG-1 or MPEG-2) audio layer 3 (MP3) player, a mobile medical device, a camera, or a wearable device (e.g., a head-mounted-device (HMD), electronic glasses, electronic clothing, an electronic bracelet, an electronic necklace, an electronic appcessory, an electronic tattoo, a smart mirror, a smart watch, etc.).

An electronic device may also be a smart home appliance, e.g., a television (TV), a digital versatile disc (DVD) player, an audio component, a refrigerator, an air conditioner, a vacuum cleaner, an oven, a microwave oven, a washing machine, an air cleaner, a set-top box, a home automation control panel, a security control panel, a TV box (e.g., Samsung HomeSync®, Apple TV®, or Google TV®), a game console (e.g., Xbox® or PlayStation®), an electronic dictionary, an electronic key, a camcorder, an electronic frame, and the like.

An electronic device may also be medical equipment, such as a mobile medical device (e.g., a blood glucose monitoring device, a heart rate monitor, a blood pressure monitoring device, a temperature meter, etc.), a magnetic resonance angiography (MRA) machine, a magnetic resonance imaging (MRI) machine, a computed tomography (CT) scanner, an ultrasound machine, etc., a navigation device, a GPS receiver, an event data recorder (EDR), a flight data recorder (FDR), an in-vehicle infotainment device, electronic equipment for a ship (e.g., a ship navigation equipment and/or a gyrocompass), avionics equipment, security equipment, a head unit for vehicle, an industrial or home robot, an automatic teller machine (ATM), a point of sale (POS) device, or an Internet of things (IoT) device (e.g., a light bulb, various sensors, an electronic meter, a gas meter, a sprinkler, a fire alarm, a thermostat, a streetlamp, a toaster, a sporting equipment, a hot-water tank, a heater, a boiler, etc.)

An electronic device may also be a piece of furniture, a building/structure, an electronic board, an electronic signature receiving device, a projector, and/or various measuring instruments (e.g., a water meter, an electricity meter, a gas meter, a wave meter, and the like).

An electronic device may also be a combination of one or more of the above-mentioned devices. Further, it will be apparent to those skilled in the art that an electronic device is not limited to the above-mentioned examples.

Herein, the term "user" may indicate a person who uses an electronic device or a device (e.g., an artificial intelligence electronic device) that uses the electronic device.

An electronic device of a single radio environment can provide LTE service using circuit switched fall back (CSFB) that determines whether paging information of a circuit switched (CS) service network is received over an LTE network. When receiving a paging signal of the CS service network over the LTE network, the electronic device connects (or accesses) the CS service network (e.g., a 2nd generation (2G)/3rd generation (3G) network) and provides a voice call service. For example, the 2G network can include one or more of a GSM network and a code division multiple access (CDMA) network. The 3G network can include one or more of a wideband-CDMA (WCDMA) network, a time division-synchronous CDMA (TD-SCDMA) network, and an evolution-data optimized (EV-DO) network.

Alternatively, the electronic device of the single radio environment can provide LTE service using single radio LTE (SRLTE), which determines whether the paging information is received by periodically switching every radio resource (e.g., receive antennas) to the CS service network (e.g., the 2G/3G network). Upon receiving the paging signal of the CS service network, the electronic device provides the voice call service by connecting the CS service network (e.g., the 2G/3G network).

Alternatively, the electronic device of the single radio environment can provide LTE service using single radio dual system (SRDS), which determines whether the paging information is received by periodically switching some of radio resources (e.g., receive antennas) to the CS service network (e.g., the 2G/3G network). Upon receiving the paging signal of the CS service network, the electronic device provides the voice call service by connecting the CS service network (e.g., the 2G/3G network).

FIG. 1 illustrates a network environment including an electronic device according to an embodiment of the present disclosure. Referring to FIG. 1, an electronic device 101 includes a bus 110, a processor 120, a memory 130, an input/output interface 150, a display 160, and a communication interface 170. Alternatively, the electronic device 100 can omit at least one of the components and/or include an additional component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a CPU, an AP, and a communication processor (CP). The processor 120 processes an operation or data for control of and/or communication with another component of the electronic device 101.

The processor 120, which may be connected to the LTE network, determines whether a call is connected over the CS service network using caller identification information (e.g., a caller phone number) of the CS service network (e.g., the 2G/3G network). For example, the processor 120 may receive incoming call information (e.g., a CS notification message or a paging request message) of the CS service network over the LTE network (e.g., CSFB). For example, the processor 120 being connected to the LTE network may receive incoming call information (e.g., a paging request message) over the CS service network (e.g., SRLTE).

When receiving the incoming call information (e.g., a CS notification message or a paging request message) of the CS service network over the LTE network, the processor 120 may obtain caller identification information from the incoming call information. The processor 120 displays the caller identification information on its display 160. The processor 120 may determine whether to connect the call based on input information corresponding to the caller identification information displayed on the display 160. For example, when detecting input information corresponding to an incoming call rejection, through the input/output interface 150, the processor 120 may restrict the voice call connection and maintains the LTE network connection. For example, when detecting input information corresponding to an incoming call acceptance, through the input/output interface 150, the processor 120 connects the voice call by connecting to the CS service network.

When receiving the incoming call information (e.g., a CS notification message or a paging request message) of the CS service network over the LTE network, the processor 120 may obtain caller identification information from the incoming call information. The processor 120 may determine whether to connect the call by comparing the caller identification information with a reception control list. For example, when the caller identification information is included in a first reception control list (e.g., a blacklist), the processor 120 may restrict the voice call connection and maintains the connection to the LTE network. For example, when the caller identification information is not included in the first reception control list (e.g., the blacklist), the processor 120 may connect the voice call by connecting to the CS service network. For example, when the caller identification information is included in a second reception control list (e.g., a white list), the processor 120 connects the voice call by connecting to the CS service network.

When receiving the incoming call information (e.g., a paging request message) of the CS service network over the LTE network, the processor 120 may transmit an incoming call response message (e.g., a paging response message) to the CS service network. The processor 120 may suspend the LTE service and receives the caller identification information (e.g., a CS call (CC) setup message) from the CS service network. The processor 120 may determine whether to connect the call by comparing the caller identification information with the reception control list. For example, when the caller identification information is included in the first reception control list (e.g., the blacklist), the processor 120 may restrict the voice call connection and resumes the LTE network connection. For example, when the caller identification information is not included in the first reception control list (e.g., the blacklist), the processor 120 may connect the voice call by connecting to the CS service network. For example, when the caller identification information is included in the second reception control list (e.g., the white list), the processor 120 connects the voice call by connecting to the CS service network.

The memory 130 may include volatile and/or nonvolatile memory. The memory 130 may store commands or data (e.g., the reception control list) relating to at least another component of the electronic device 101. The memory 130 stores software and/or a program 140. The program 140 includes a kernel 141, middleware 143, an application programming interface (API) 145, and applications 147. At least some of the kernel 141, the middleware 143, and the API 145 may be referred to as an operating system (OS).

The kernel 141 may control or manage system resources (e.g., the bus 110, the processor 120, or the memory 130) used for performing an operation or function implemented by the other programs (e.g., the middleware 143, the API 145, or the applications 147). Further, the kernel 141 provides an interface through which the middleware 143, the API 145, or the applications 147 may connect the individual elements of the electronic device 101 to control or manage the system resources.

The middleware 143 may function as an intermediary for the API 145 or the applications 147 to communicate with the kernel 141 and exchange data. In addition, the middleware 143 may process one or more task requests received from the applications 147 according to priorities thereof. For example, the middleware 143 may assign priorities for using the system resources (e.g., the bus 110, the processor 120, the memory 130, and the like) of the electronic device 101, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function (e.g., an instruction) for file control, window control, image processing, text control, etc.

The input/output interface 150 transfers instructions or data input from a user or another external device to the other element(s) of the electronic device 101. Further, the input/output interface 150 outputs the instructions or data received from the other element(s) of the electronic device 101 to the user, a first external electronic device 102, a second external electronic device 104, or a server 106.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., a text, images, videos, icons, symbols, webpages, etc.) for the user. The display 160 may include a touch screen that receives a touch input, a gesture input, a proximity input, a hovering input, etc., from an electronic pen or the user's body part.

The communication interface 170 establishes communication between the electronic device 101 and the first external electronic device 102, the second external electronic device 104, or the server 106. For example, the communication interface 170 can communicate with the first external electronic device 102 through a wireless communication or a wired communication 164, and communicate with the second external electronic device 104 or the server 106 in connection to a network 162 through wireless communication or wired communication. For example, the wireless communication may conform to a cellular communication protocol including at least one of LTE, LTE-advanced (LTE-A), CDMA, Wideband CDMA (WCDMA), universal mobile telecommunications system (UMTS), wireless broadband (WiBro), and GSM.

The wired communication 164 can include at least one of universal serial bus (USB), high definition multimedia interface (HDMI), recommended standard 232 (RS-232), and plain old telephone service (POTS).

The network 162 may include a telecommunications networks, a computer network (e.g., a local area network (LAN) or a wide area network (WAN)), the Internet, a telephone network, etc.

The electronic device 101 provides the LTE service in the single radio environment by use of at least one module functionally or physically separated from the processor 120.

Various embodiments of the present disclosure will be described with reference to a display that includes a bent or curved area and is applied to a housing of an electronic device 101, in which a non-metal member and a metal member (e.g., a metal bezel) are formed through dual injection molding, but are not limited thereto. For example, the display 160 may be applied to a housing, in which a metal member or a non-metal member is formed of a single material.

Each of the first external electronic device 102 and the second external electronic device 104 may be a same or a different type of device as the electronic device 101.

The server 106 may include a group of one or more servers.

All or some of the operations to be executed by the electronic device 101 may be executed by the first external electronic device 102, the second external electronic device 104, and/or the server 106. For example, when the electronic device 101 should perform a certain function, the electronic device 101 may request some functions that are associated therewith from the first external electronic device 102, the second external electronic device 104, and/or the server 106, instead of or in addition to executing the function or service by itself. The first external electronic device 102, the second external electronic device 104, or the server 106 may execute the requested functions or additional functions, and may transmit the results to the electronic device 101. The electronic device 101 may provide the requested functions or services by processing the received results as they are or after additionally. For example, a cloud computing technique, a distributed computing technique, or a client-server computing technique may be used.

In accordance with an embodiments of the present disclosure, a part of a metal bezel that serves as the outer periphery of an electronic device is used as a first antenna member, and a second antenna member that contributes to an internal housing of the electronic device is connected to the first antenna member. Alternatively, at least one metal structure that is disposed in a suitable position of the electronic device may be applied to first antenna member.

Figure 2A:
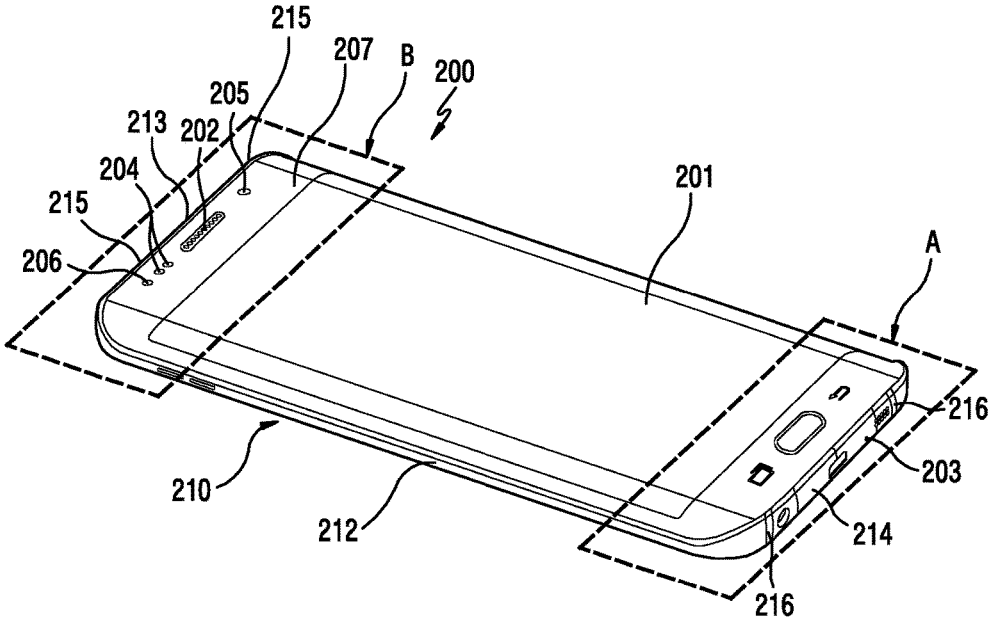
FIG. 2A is a front perspective view illustrating an electronic device according to an embodiment of the present disclosure.
Figure 2B:
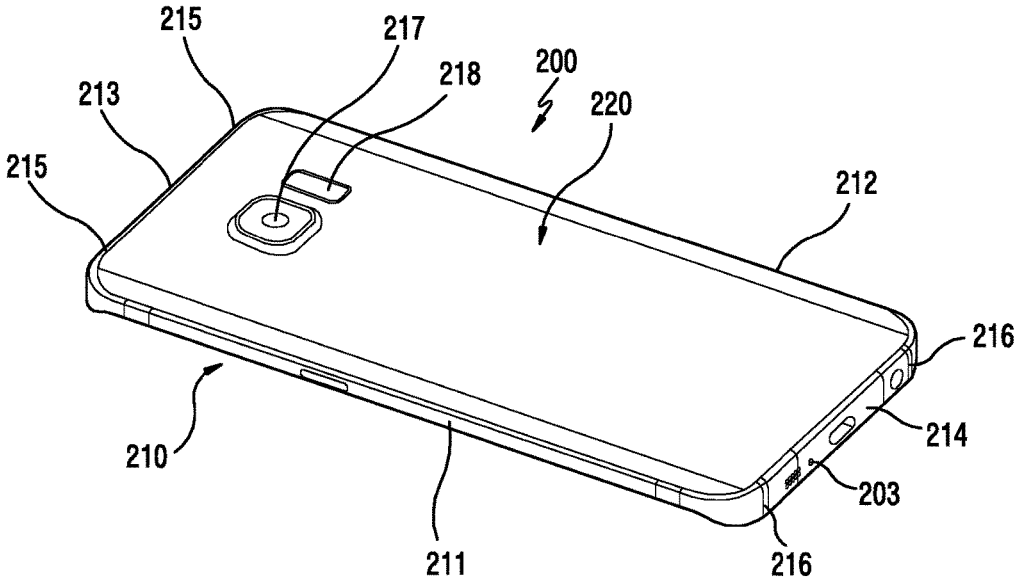
FIG. 2B is a rear perspective view illustrating an electronic device according to an embodiment of the present disclosure.

FIGS. 2A and 2B are front and rear perspective views, respectively, illustrating an electronic device according to an embodiment of the present disclosure.

Referring to FIG. 2A, a display 201 is installed on a front side 207 of the electronic device 200. A speaker 202 is installed on an upper side of the display 201. A microphone device 203 is installed on a lower side of the display 201.

A sensor module 204, a camera 205, and an LED indicator 206 are disposed around the speaker 202. For example, the sensor module 204 may an illumination sensor (e.g., an optical sensor), a proximity sensor, an infrared sensor, and an ultrasonic sensor. Additional components for performing various functions of the electronic device 200 may also be disposed around the speaker 202.

The electronic device 200 includes a metal bezel 210 disposed along an outer periphery of the electronic device 200. The metal bezel 210 may also be disposed to extend to at least a part of the back side of the electronic device 200, which is connected to the outer periphery of the electronic device. The metal bezel 210 may define the thickness of the electronic device along the outer periphery of the electronic device 200 and may be formed in a loop shape. However, without being limited thereto, the metal bezel 210 may also be formed to contribute to at least a part of the thickness of the electronic device 200.

The metal bezel 210 may also be disposed only in a partial area of the outer periphery of the electronic device 200.

When viewed from the front of the electronic device 200, the metal bezel 210 includes a right bezel part 211, a left bezel part 212, an upper bezel part 213, and a lower bezel part 214. The metal bezel 210 also includes segments 215 and 216. The upper bezel part 213 and the lower bezel part 214, which may be used as first antenna members, are separated from the right bezel part 211 and the left bezel part 212 by the segments 215 and 216.

An antenna device that includes first and second antenna members, which will be described below, may be disposed area A or B of the electronic device 200 that is least affected when the electronic device 200 is held. However, without being limited thereto, the antenna device may also be disposed lengthwise on at least one of the opposite lateral sides of the electronic device 200 other than the area A or B.

Various radiators, which may be disposed on the outer surface of the housing of the electronic device, may be used as the second antenna members. The second antenna members may serve as Flexible Printed Circuit Board (FPCB) type antenna devices or Thin FPCB Antennas (TFAs). The second antenna members may also be configured in various forms, such as a printed antenna, an In-Mold Antenna (IMA) type antenna, a single-stage metal plate, etc., in addition to the TFA.

The second antenna members may be attached to the rear housing of the electronic device.

The second antenna members may be feed-connected to a PCB in the electronic device by electrical mediums.

The second antenna members may be electrically connected to the above-described metal structures (e.g., upper bezel part 213 and the lower bezel part 214 of the metal bezel 210) that are used as the first antenna members in the electronic device.

The second antenna members may also be disposed to be brought into direct contact with metal parts that are independently disposed on the rear housing.

The metal parts may be formed of the same material as that of the first antenna members or may be formed of a different material than the first antenna members.

Referring to FIG. 2B, a cover member 220 may be further installed on the back side of the electronic device 200. The cover member 220 may be a battery cover for protecting a battery pack of the electronic device 200 and making the external appearance of the electronic device 200 appealing. However, without being limited thereto, the cover member 220 may be integrated with the electronic device 200 and serve as the rear housing of the electronic device. For example, when the battery pack is integrally employed in the electronic device, the cover member 220 may be replaced by the rear housing of the electronic device. In this case, at least a part of the rear housing may also be formed of a metal material and may serve as a first antenna member.

The cover member 220 may be formed of various materials, such as metal, glass, a composite material, a synthetic resin, etc.

A camera 217 and a flash 218 are disposed on the back side of the electronic device 200.

Figure 3:
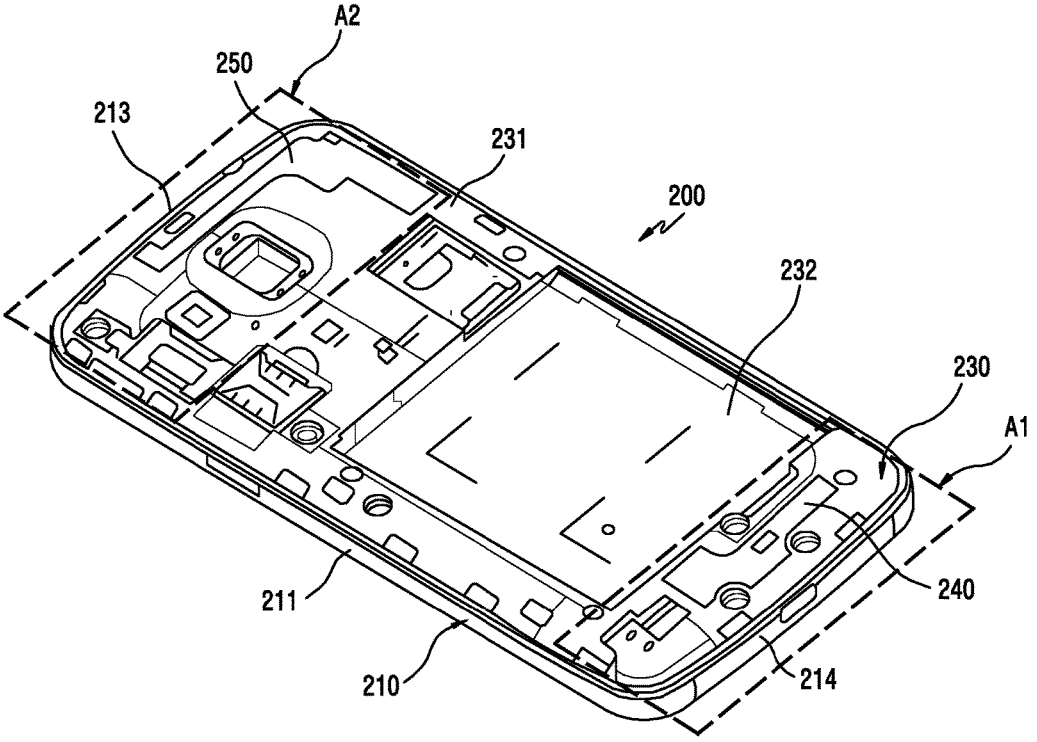
FIG. 3 is a perspective view illustrating second antenna members disposed in a housing of an electronic device, according to an embodiment of the present disclosure.

FIG. 3 is a perspective view illustrating second antenna members disposed in a housing of an electronic device, according to an embodiment of the present disclosure.

Referring to FIG. 3, a cover member mounting part 231 of the housing 230, from which the cover member 220 of the electronic device 200 is excluded, is provided. The cover member mounting part 231 includes a battery pack mounting part 232 for accommodating a battery pack therein.

The electronic device 200 includes, on the cover member mounting part 231, a first antenna radiation part A1 disposed on the lower side of the electronic device 200 and a second antenna radiation part A2 disposed on the upper side of the electronic device 200.

The first antenna radiation part A1 includes the lower bezel part 214 that is used as a first antenna member among the metal bezel 210 of the electronic device 200 and a second antenna member 240 that is electrically connected to the lower bezel part 214 and is accommodated in the housing 230. Alternatively, the right bezel part 211 and the left bezel part 212, as well as the upper bezel part, may be used as antenna members.

The second antenna radiation part A2 includes the upper bezel part 213 that is used as a first antenna member and a second antenna member 250 that is electrically connected to the upper bezel part 213 and is accommodated in the housing 230.

Each of the second antenna members 240 and 250 may be disposed on the cover member mounting part 231 of the housing 230 and may be directly feed-connected, or grounded, to a PCB while passing through the housing 230. The second antenna members 240 and 250 may be disposed on the inner surface of the housing 230 and may be directly feed-connected, or grounded, to the PCB. The second antenna members 240 and 250 may be disposed on the outer or inner surface of the housing 230 and coupled to the housing, and may be directly and/or electrically connected to the lower and upper bezel parts 214 and 213 of the electronic device that serve as the first antenna members.

The second antenna members 240 and 250 may be directly feed-connected, or grounded, to the PCB by metal parts that are independently disposed in the housing 230.

The second antenna members 240 and 250 may also be coupled to the housing 230 while being disposed on the outer or inner surface of the housing 230 through metal parts that are distinguished from the first antenna members by non-metal injection-molded regions in the housing 230 and are independently disposed in via holes that are formed in the injection-molded regions, and may be directly and electrically connected to the lower and upper bezel parts 214 and 213 that serve as the first antenna members.

When being independently and electrically connected to the PCB, without electrical connection with the first antenna members, the second antenna members 240 and 250 may operate as parasitic antenna devices of the first antenna members, or may operate as independent antenna devices.

When being electrically connected to the first antenna members, the second antenna members 240 and 250 may also serve as extension antenna members to change the operating frequency band (e.g., 800 MHz to 960 MHz or 1710 MHz to 2170 MHz) of the first antenna members, to extend a bandwidth by generating a separate additional operating frequency band, etc.

The second antenna members 240 and 250 may be feed-connected to antenna feed parts of the PCB, or may be grounded to ground parts of the PCB.

In order to form conductive layers that transmit and receive electrical signals, the second antenna members 240 and 250 may be formed on the housing by a Laser Direct Structuring (LDS) method or an IMA method, by attaching at least one of a Flexible Printed Circuit Board (FPCB) having a thin metal plate or pattern formed thereon and a metal tape to the housing 230, by applying a conductive spray to the housing 230, or by insert molding or double injection molding in such a manner as to be exposed, or not to be exposed, through the housing 230.

Figure 4A:
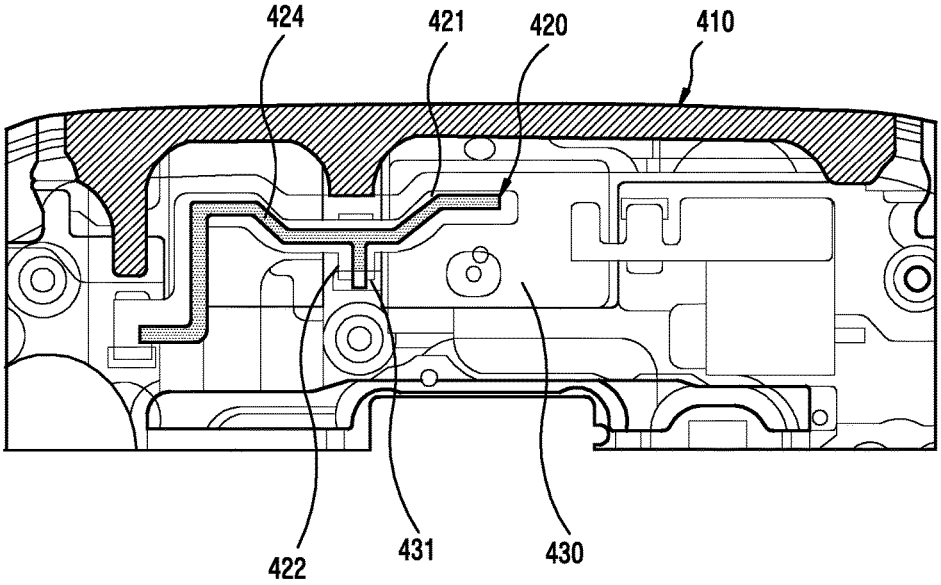
FIGS. 4A and 4B illustrate a second antenna member disposed on a housing and electrically connected to a PCB, according to an embodiment of the present disclosure.
Figure 4B:
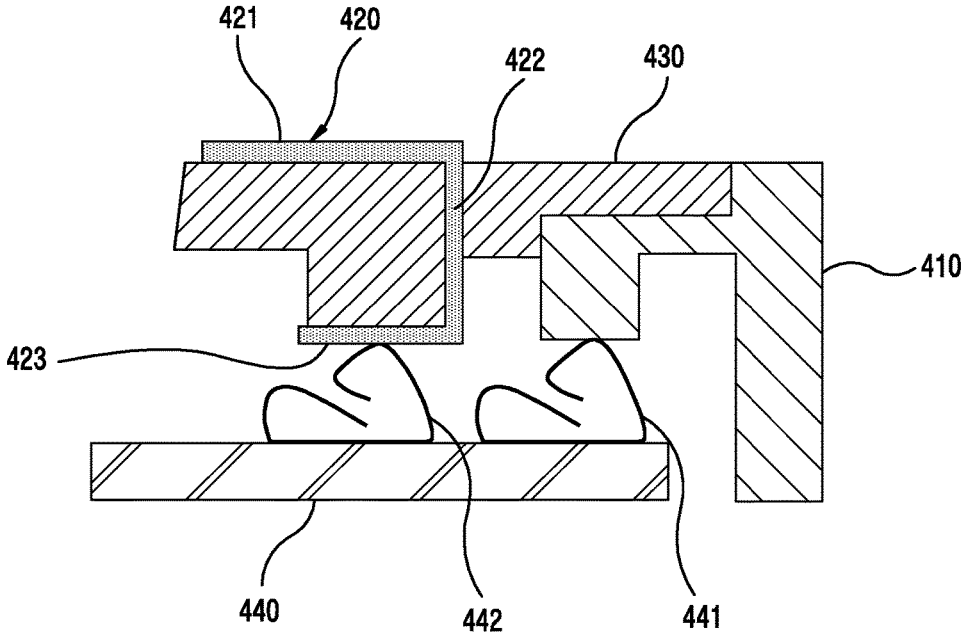

FIGS. 4A and 4B illustrate a second antenna member disposed on a housing and electrically connected to a PCB, according to an embodiment of the present disclosure.

Referring to FIGS. 4A and 4B, an antenna device includes a first antenna member 410 for which at least a part of a metal bezel, which serves as the outer periphery of an electronic device, is used as a radiator, a second antenna member 420 disposed on a housing 430 of the electronic device, and a PCB 440 that is disposed within the electronic device and to which the first and second antenna members 410 and 420 are electrically connected. According to an embodiment, the first and second antenna members 410 and 420 may be brought into physical contact with each other by first and second electrical connection members 441 and 442. For example, C-clips, metal springs, etc., may be used as the electrical connection members 441 and 442.

The second antenna member 420 may be attached to the outer surface of the housing 430. The second antenna member 420 includes a radiation part 421 including a radiation pattern 424, a connection part 422 that extends from the radiation part 421 and is inserted into the housing 430 through a through-hole 431 formed in the housing 430, and a terminal part 423 that extends from the connection part 422 and is attached to the inner surface of the housing 430 to be brought into physical contact with the second electrical connection member 442. The radiation pattern 424 may extend to the radiation part 421, the connection part 422, and the terminal part 423 of the second antenna member 420 in order to physical contact the electrical connection member 442. Accordingly, the radiation pattern 424 may be partially exposed through the terminal part 423.

The first antenna member 410 may be electrically connected to a first feed part of the PCB 440, and the second antenna member 420 may be electrically connected to a second feed part of the PCB 440. The second antenna member 420 may operate independently of the first antenna member 410. The second antenna member 420 may also operate as an extension antenna radiator of the first antenna member 410. The second antenna member 420 may be electrically connected to a ground part of the PCB 440 in order to extend a ground area.

Figure 5:
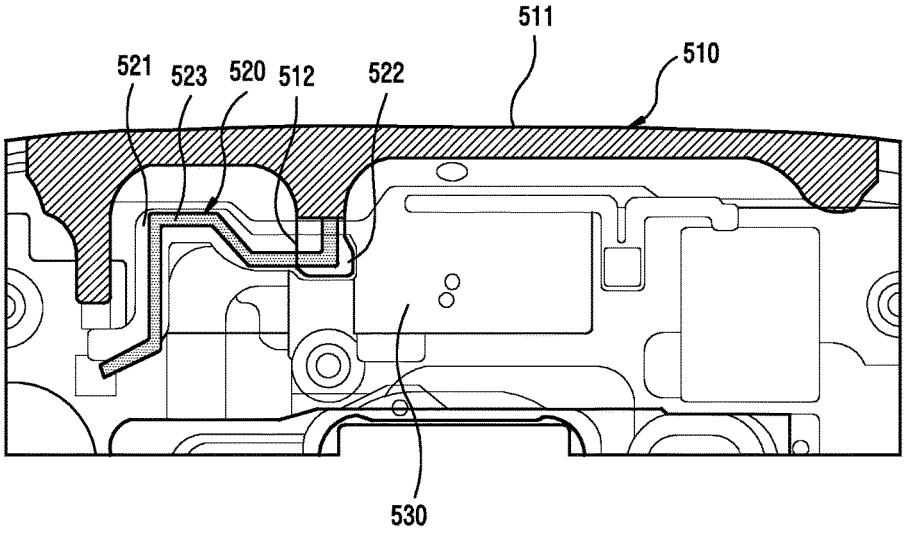
FIG. 5 illustrates a second antenna member disposed on a housing and electrically connected to a first antenna member that serves as a part of a metal structure of an electronic device, according to an embodiment of the present disclosure.

FIG. 5 illustrates a second antenna member disposed on a housing and electrically connected to a first antenna member that serves as a part of a metal structure of an electronic device, according to an embodiment of the present disclosure.

Referring to FIG. 5, an antenna device includes a first antenna member 511 for which at least a part of the metal bezel 510, which serves as the outer periphery of the electronic device, is used as a radiator, and a second antenna member 520 disposed on a housing 530 of the electronic device.

The second antenna member 520 may be attached to the outer surface of the housing 530. The second antenna member 520 includes a radiation part 521 that includes a radiation pattern 523 and a terminal part 522 that extends from the radiation part 521. The housing 530 of the electronic device, together with the metal bezel 510, may be formed as the final housing of the electronic device by double injection molding, insert molding, etc. In this case, the housing 530 may be formed as a non-conductive structure made of a PCB material.

The first antenna member 511 includes a connection rib 512 that extends from the first antenna member 511 toward the housing 530. When the metal bezel 510 and the housing 530 are double-injection molded, the connection rib 512 may be exposed through the outer surface of the housing 530.

The second antenna member 520 may be electrically connected to the connection rib 512, which is at least partially exposed through the housing 530, by a physical contact therebetween. Alternatively, the second antenna member 520 and the connection rib 512 may be connected through an electromagnetic coupling that is induced when the radiation pattern 523 within the second antenna member 520 and the connection rib 512 overlap, or are close to each other, e.g., within a predetermined distance.

Accordingly, the second antenna member 520 may serve as an extension antenna radiator of the first antenna member 511.

The operating frequency band of the first antenna member 511 may be adjusted, or the bandwidth thereof may be extended, by the second antenna member 520.

Figure 6A:
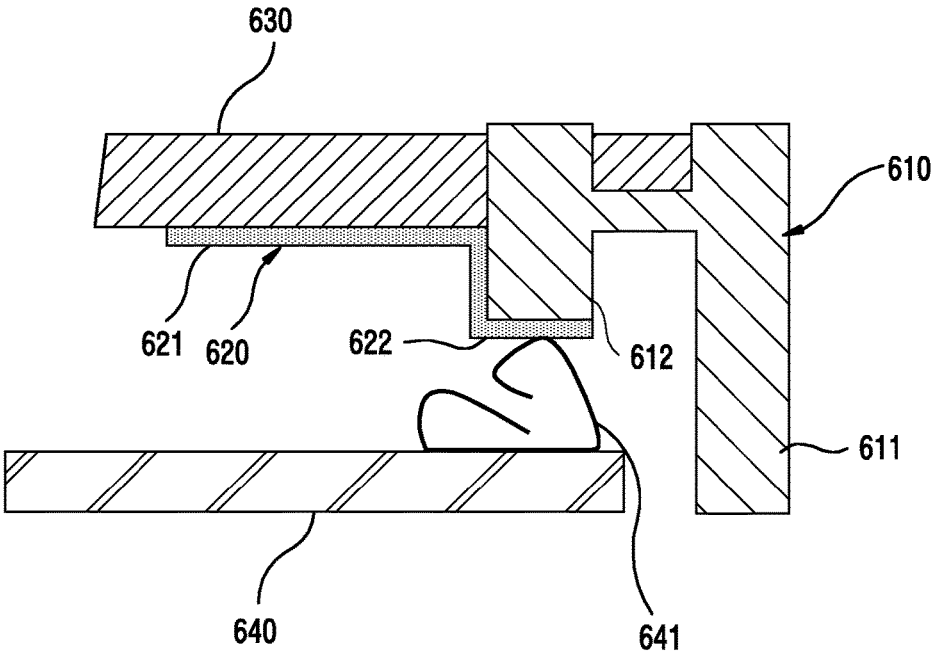
FIGS. 6A and 6B illustrate a second antenna member disposed on a housing and electrically connected to a first antenna member that serves as a part of a metal structure of an electronic device, according to an embodiment of the present disclosure.
Figure 6B:
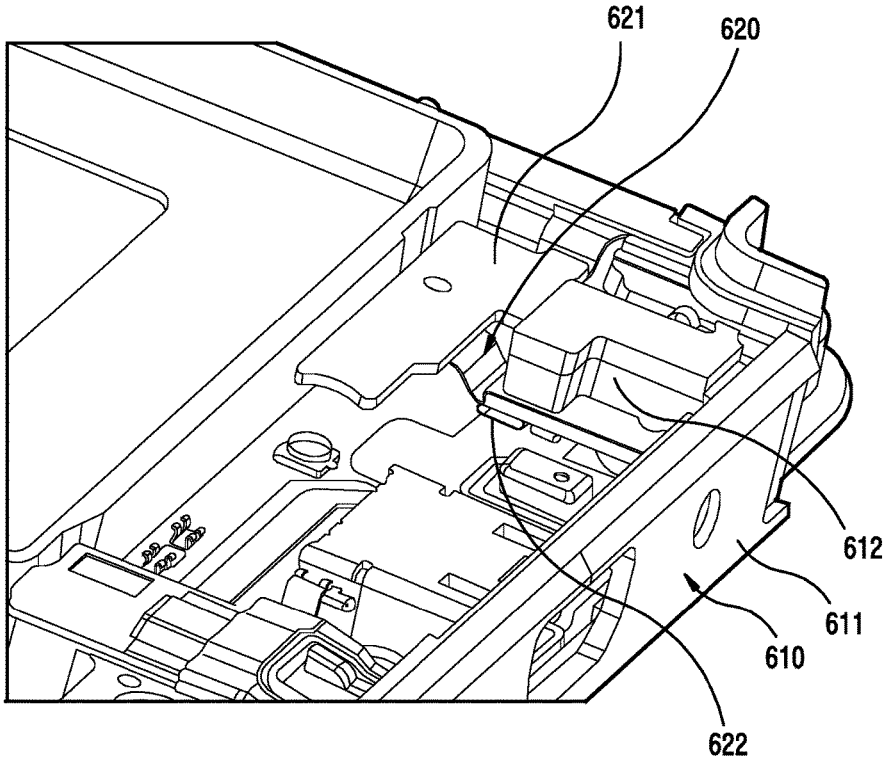

FIGS. 6A and 6B illustrate a second antenna member disposed on a housing and electrically connected to a first antenna member that serves as a part of a metal structure of an electronic device, according to an embodiment of the present disclosure.

Referring to FIGS. 6A and 6B, an antenna device includes a first antenna member 611 for which at least a part of the metal bezel 610, which serves as the outer periphery of the electronic device, is used as a radiator, and a second antenna member 620 disposed on a housing 630 of the electronic device.

The second antenna member 620 may be attached to the inner surface of the housing 630. The second antenna member 620 includes a radiation part 621 that includes a radiation pattern and a terminal part 622 that extends from the radiation part 621.

The first antenna member 611 includes a connection rib 612 that extends from the first antenna member 611 toward the housing 630. When the metal bezel 610 and the housing 630 are double-injection molded, the connection rib 612 may be exposed through the inner surface of the housing 630.

The second antenna member 620 may be electrically connected to the connection rib 612, which is exposed through the inner surface of the housing 630, by a physical contact therebetween.

The terminal part 622 of the second antenna member 620 may be electrically connected to the connection rib 612 of the first antenna member 611 and may be feed-connected to a PCB 640 by an electrical connection member 641. Accordingly, the second antenna member 620 may serve as an extension antenna radiator of the first antenna member 611.

The operating frequency band of the first antenna member 611 may be changed by the second antenna member 620, an additional resonant frequency may be made by the second antenna member 620, or the bandwidth of the first antenna member may be extended by using the additional resonant frequency.

High-band resonance may be operated by an antenna radiator itself within the second antenna member 620, the first and/or second resonant frequency of the first antenna member 611 may be controlled by the second antenna member 620, and it is possible to extend a bandwidth by generating additional resonance with the radiator of the second antenna member 620 and coupling the additional resonance with high-band antenna resonance generated by the first antenna member 611.

FIGS. 7 to 11 illustrate a second antenna member disposed on a housing and connected electrically to a first antenna member that serves as a part of a metal structure of an electronic device, according to various embodiments of the present disclosure.

Figure 7:
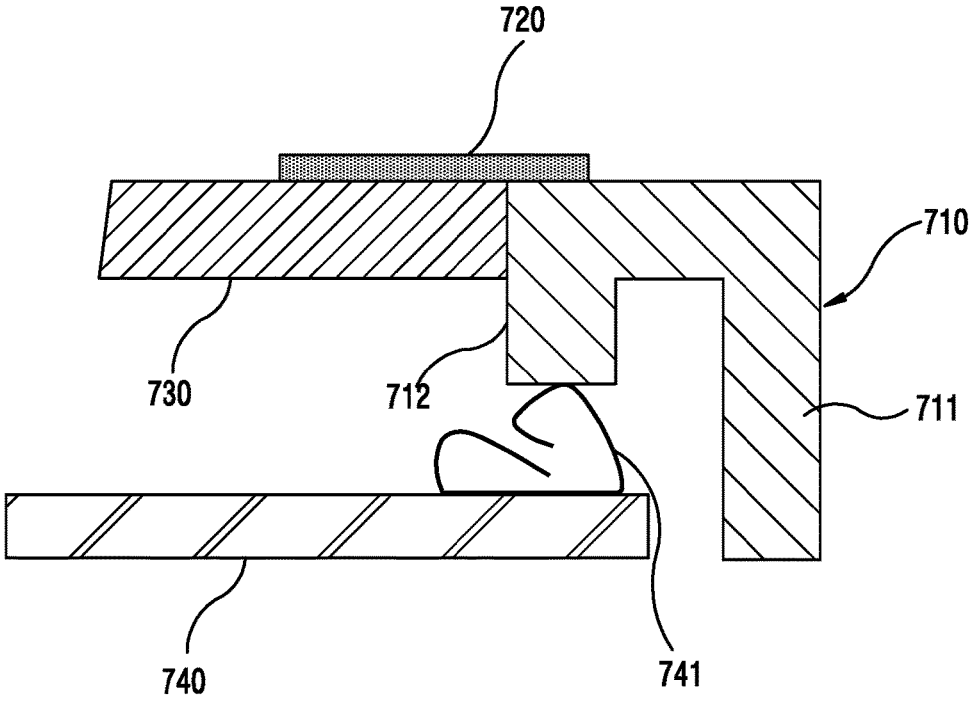
FIGS. 7 to 11 illustrate a second antenna member disposed on a housing and connected electrically to a first antenna member that serves as a part of a metal structure of an electronic device, according to various embodiments of the present disclosure.

Referring to FIG. 7, an antenna device includes a first antenna member 711 for which at least a part of a metal bezel 710, which serves as the outer periphery of an electronic device, is used as a radiator, and a second antenna member 720 disposed on a housing 730 of the electronic device.

The second antenna member 720 may be attached to the outer surface of the housing 730. The first antenna member 711 includes a connection rib 712 that extends from the first antenna member 711 toward the housing 730. When the metal bezel 710 and the housing 730 are double-injection molded, the connection rib 712 may be exposed through the outer surface of the housing 730.

The second antenna member 720 is electrically connected to the connection rib 712, which is exposed through the outer surface of the housing 730, by a physical contact therebetween. For example, the connection rib 712 of the first antenna member 711 is connected to an RF IC chip on a PCB 740 by an electrical connection member 741 so that the connection rib 712 may be feed-connected to the PCB 740 through the connection member 741. Accordingly, the second antenna member 720 may serve as an extension antenna radiator of the first antenna member 710.

Figure 8:
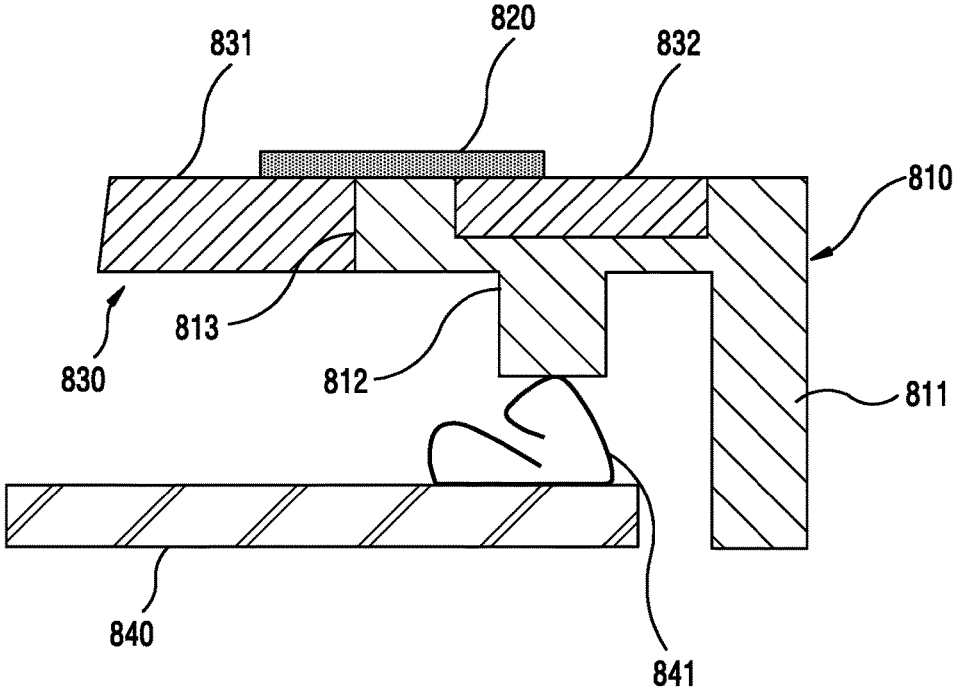

Referring to FIG. 8, an antenna device includes a first antenna member 811 for which at least a part of a metal bezel 810, which serves as the outer periphery of an electronic device, is used as a radiator, and a second antenna member 820 disposed on a housing 830 of the electronic device.

The second antenna member 820 may be attached to the outer surface of the housing 830. The first antenna member 811 includes a connection rib 813 that extends from the first antenna member 811 toward the housing 830. When the metal bezel 810 and the housing 830 are double-injection molded, the connection rib 813 may be exposed through the outer surface of the housing 830. A protruding rib 812 extends downward from the connection rib 813. The protruding rib 812 physically contacts an electrical connection member 841 mounted on a PCB 840 to electrically connect the first antenna member 811 and the second antenna member 820, which contacts the first antenna member 811, to the PCB 840.

The housing 830 includes a first injection-molded part 831 and a second injection-molded part 832. The second injection-molded part 832 may be injection-molded to be positioned in a recess that is formed in the connection rib 813 of the second antenna member 820. The second antenna member 820 may be fixed in such a manner that the second antenna member 820 is simultaneously attached to the first injection-molded part 831, the second injection-molded part 832, and the connection rib 813, thereby enhancing the adhesive property of the flexible antenna member and preventing a connection trouble caused by a crack of an interface between different materials.

Figure 9:
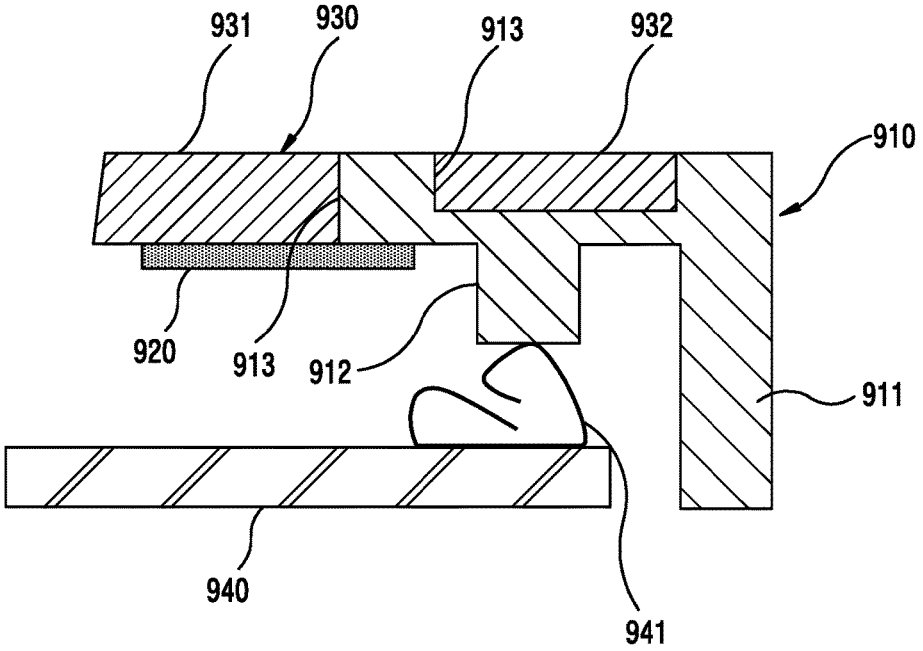

Referring to FIG. 9, an antenna device includes a first antenna member 911 for which at least a part of a metal bezel 910, which serves as the outer periphery of an electronic device, is used as a radiator, and a second antenna member 920 disposed on a housing 930 of the electronic device.

The second antenna member 920 may be attached to the inner surface of the housing 930. The first antenna member 911 includes a connection rib 913 that extends from the first antenna member 911 toward the housing 930. When the metal bezel 910 and the housing 930 are double-injection molded, the connection rib 913 may be exposed through the inner surface of the housing 930.

A protruding rib 912 extends downward from the connection rib 913. The protruding rib 912 physically contacts an electrical connection member 941 mounted on a PCB 940 to electrically connect the first antenna member 911 and the second antenna member 920, which contacts the first antenna member 911, to the PCB 940.

The housing 930 includes a first injection-molded part 931 and a second injection-molded part 932. The second injection-molded part 932 may be injection-molded to be positioned in a recess that is formed in the connection rib 913 of the second antenna member 920, which helps maintain the coupling of the housing 930 and the metal bezel 910 that are formed of different materials.

Figure 10:
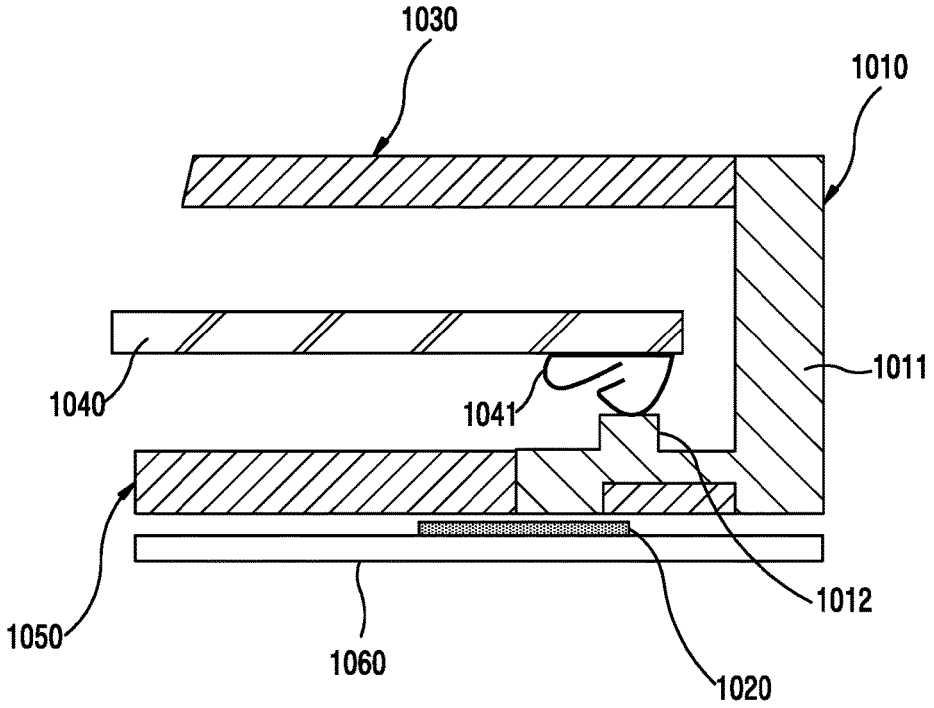

Referring to FIG. 10, an antenna device includes a first antenna member 1011 for which at least a part of a metal bezel 1010, which serves as the outer periphery of an electronic device, is used as a radiator, and a second antenna member 1020 disposed to be directed toward another housing 1050 opposite to a housing 1030 of the electronic device.

The housing 1030 of the electronic device may serve as a rear housing, and the other housing 1050 may serve as a front housing. In this case, the second antenna member 1020 may be disposed on a portion through which the first antenna member 1011 is exposed among the outer surface of the front housing 1050.

The second antenna member 1020 may also be disposed on a window 1060 that faces the front housing 1050. In this case, the second antenna member 1020 may be attached to the window 1060, e.g., by bonding, taping, etc.

The second antenna member 1020 may be disposed in a Black Mask (BM) area of the window 1060.

When the window 1060 is mounted on the front housing 1050, the second antenna member 1020 disposed on the rear surface of the housing 1050 may be electrically connected to the first antenna member 1011, which is exposed through the front housing 1050, by a natural surface-to-surface contact therebetween.

A protruding rib 1012 may extend downward from a connection rib 1013. The protruding rib 1012 physically contacts an electrical connection member 1041 mounted on a PCB 1040 to electrically connect the first antenna member 1011 and the second antenna member 1020, which contacts the first antenna member 1011, to the PCB 1040.

Figure 11:
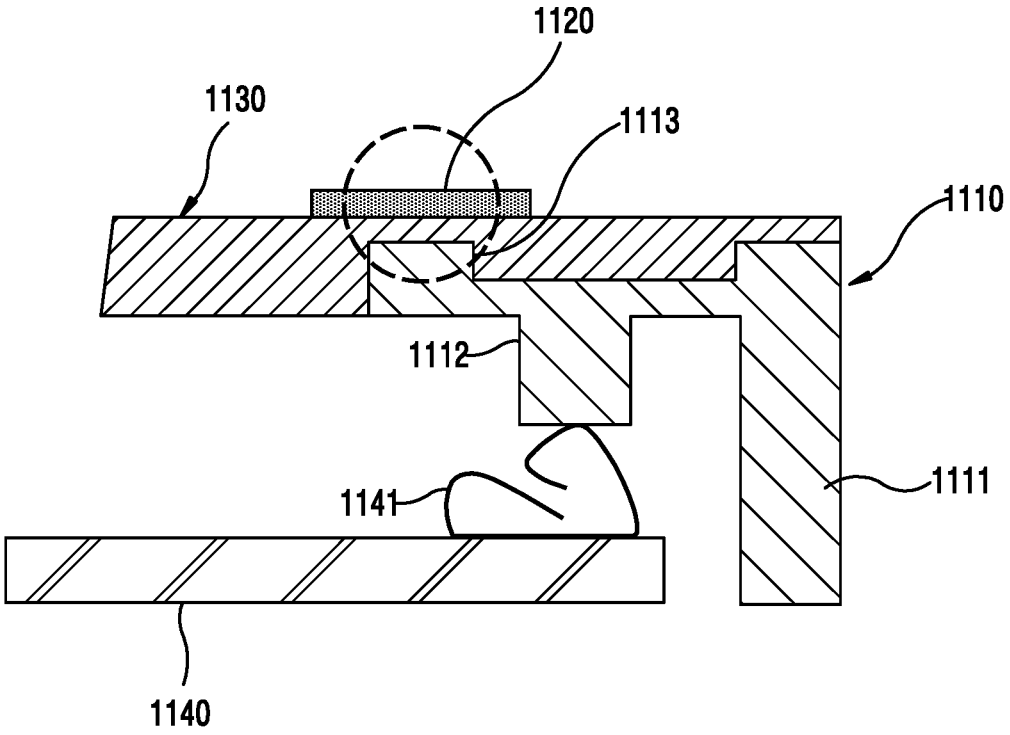

Referring to FIG. 11, an antenna device includes a first antenna member 1111 for which at least a part of a metal bezel 1110, which serves as the outer periphery of an electronic device, is used as a radiator, and a second antenna member 1120 disposed on a housing 1130 of the electronic device.

The second antenna member 1120 may be attached to the outer surface of the housing 1130. The first antenna member 1111 includes a connection rib 1113 that extends from the first antenna member 1111 toward the housing 1130. When the metal bezel 1110 and the housing 1130 are double-injection molded, the connection rib 1113 may be formed so as to not be exposed through the outer surface of the housing 1130. The connection rib 1113 is not exposed through the housing 1130, but may be disposed around the second antenna member 1120.

The second antenna member 1120 may be electrically connected to the connection rib 1113 of the first antenna member 1111 by a non-contact coupling operation.

A protruding rib 1112 extends downward from the connection rib 1113. The protruding rib 1112 physically contacts an electrical connection member 1141 mounted on a PCB 1140 to electrically connect the first antenna member 1111 and the second antenna member 1120, which contacts the first antenna member 1111, to the PCB 1140.

The housing 1130 may be disposed in various positions in the electronic device. For example, the housing 1130 may serve as the rear or front housing of the electronic device, or may serve as a bracket disposed within the electronic device.

Figure 12A:
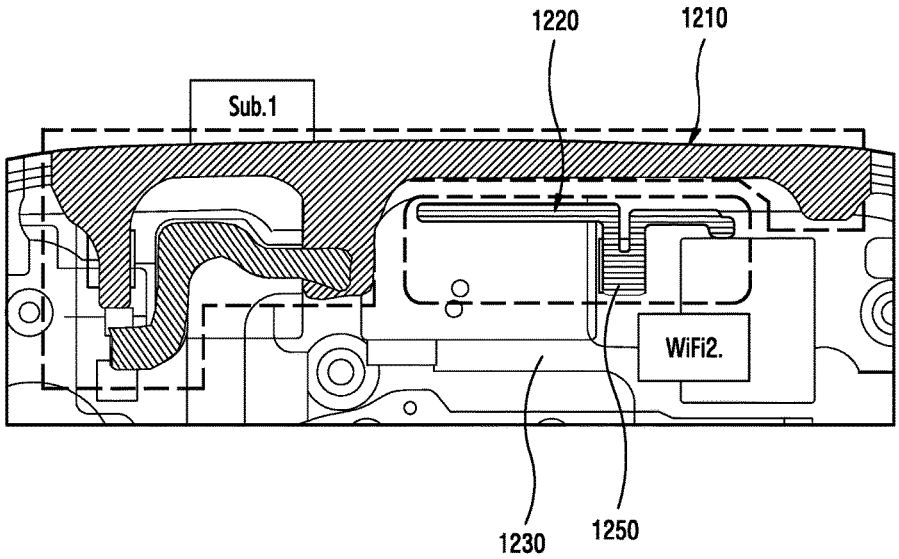
FIGS. 12A and 12B illustrate a second antenna member connected to a first antenna member through a metal part in a housing, according to an embodiment of the present disclosure.
Figure 12B:
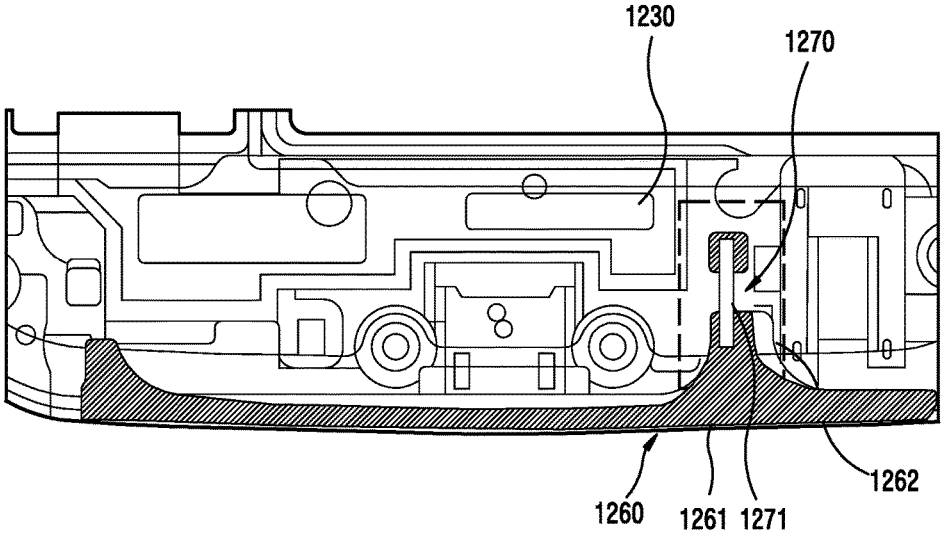

FIGS. 12A and 12B illustrate a second antenna member connected to a first antenna member through a metal part disposed in a housing, according to an embodiment of the present disclosure.

Referring to FIG. 12A, an antenna device includes a first antenna member 1210 that serves as at least a part of a metal bezel that is coupled as a part of a housing 1230 and a second antenna member 1220 that is independently disposed on the housing 1230 and is directly and electrically connected to a PCB. The second antenna member 1220, which is disposed on the housing 1230, physically contacts an electrical connection member, which is mounted on the PCB, by a metal part 1250 that is simultaneously exposed through the outer and inner surfaces of the housing 1230. In this case, the first and second antenna members 1210 and 1220 may be separately electrically connected to the PCB.

Referring to FIG. 12B, an antenna device includes a first antenna member 1261 that serves as at least a part of a metal bezel 1260 that is coupled as a part of a housing and a second antenna member 1270 that is independently disposed on the housing 1230 and includes a radiation pattern 1271 that is directly and electrically connected to a PCB. The second antenna member 1270, which is disposed on the housing 1230, and physically contacts an electrical connection member, which is mounted on the PCB, by a metal part that is simultaneously exposed through the outer and inner surfaces of the housing 1230. In this case, the second antenna member 1270 may be simultaneously electrically connected to a metal island exposed through the outer surface of the housing 1230 and a connection rib 1262 of the first antenna member 1261 to serve as an extension antenna radiator.

Figure 13:
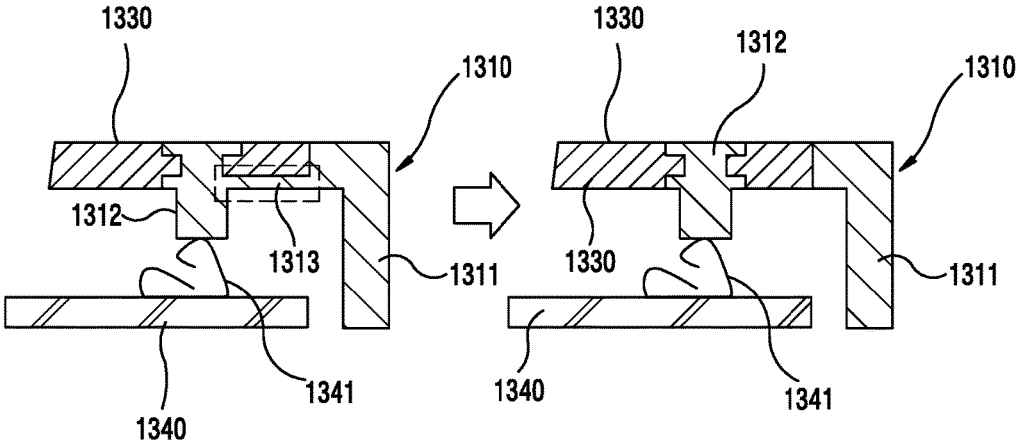
FIG. 13 illustrates a process of manufacturing a metal part according to an embodiment of the present disclosure.

FIG. 13 illustrates a process of manufacturing a metal part 912 according to various embodiments of the present disclosure.

Referring to FIG. 13, a metal bezel 1310 may be formed by a die-casting process, an injection molding process, a press process, etc. wherein a first antenna member 1311 and a metal part 1312 are connected to each other by a bridge 1313. The bridge 1313 may be removed through machining after the housing 1330 made of a synthetic resin is double-injection molded or insert molded together with the metal bezel 1310. In this case, the first antenna member 1311 of the metal bezel and the metal part 1312 may be maintained to be electrically isolated from each other by the housing 1330 injection-molded of a synthetic resin. The metal part 1312 may be formed such that at least a part thereof is exposed through the upper and lower surfaces of the housing for electrical connection. Accordingly, the metal part 1312 physically contacts an electrical connection member 1341 mounted on a PCB 1340 so that the antenna member attached to the metal part 1312 may be electrically connected to the PCB 1340.

FIGS. 14 to 19 illustrate a second antenna member establishing an electrical connection through a metal part disposed on a housing, according to various embodiments of the present disclosure.

Figure 14:
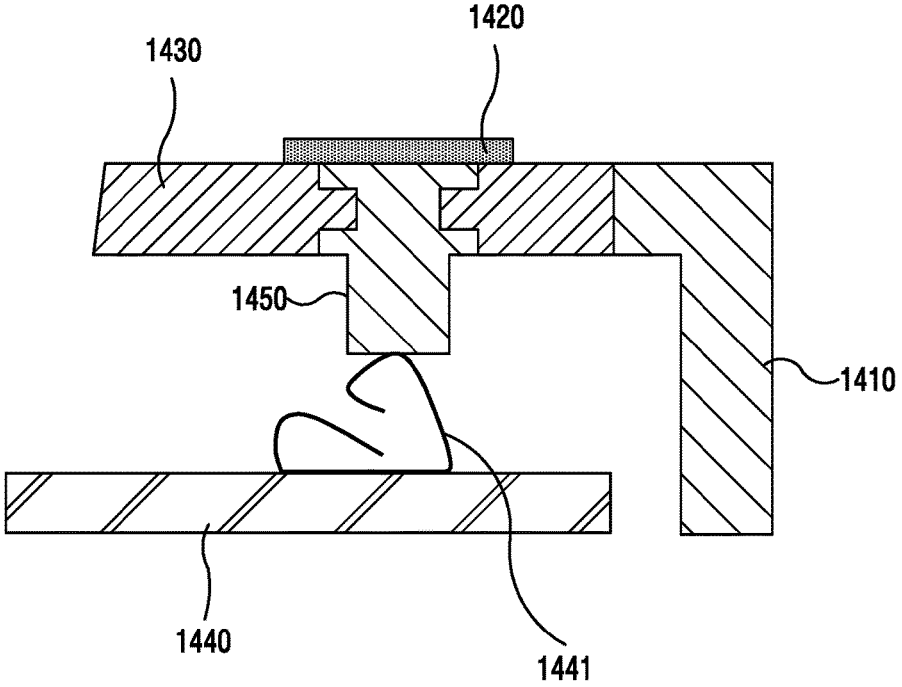
FIGS. 14 to 22 illustrate a second antenna member that is connected electrically through a metal part disposed on a housing, according to various embodiments of the present disclosure.

Referring to FIG. 14, a first antenna member 1410 that serves as a part of a metal bezel and a housing 1430 are integrally formed with each other, and a second antenna member 1420 is disposed on a portion through which a metal part 1450 is exposed among the outer surface of the housing 1430. In this case, the second antenna member 1420 may establish an electrical connection by the metal part 1450 through an electrical connection member 1441 mounted on a PCB 1440. The second antenna member 1420 may independently operate as an antenna radiator, and the first antenna member 1410 may also independently operate as an antenna radiator, or may serve as an extended ground stub through coupling with the second antenna member 1420.

Figure 15:
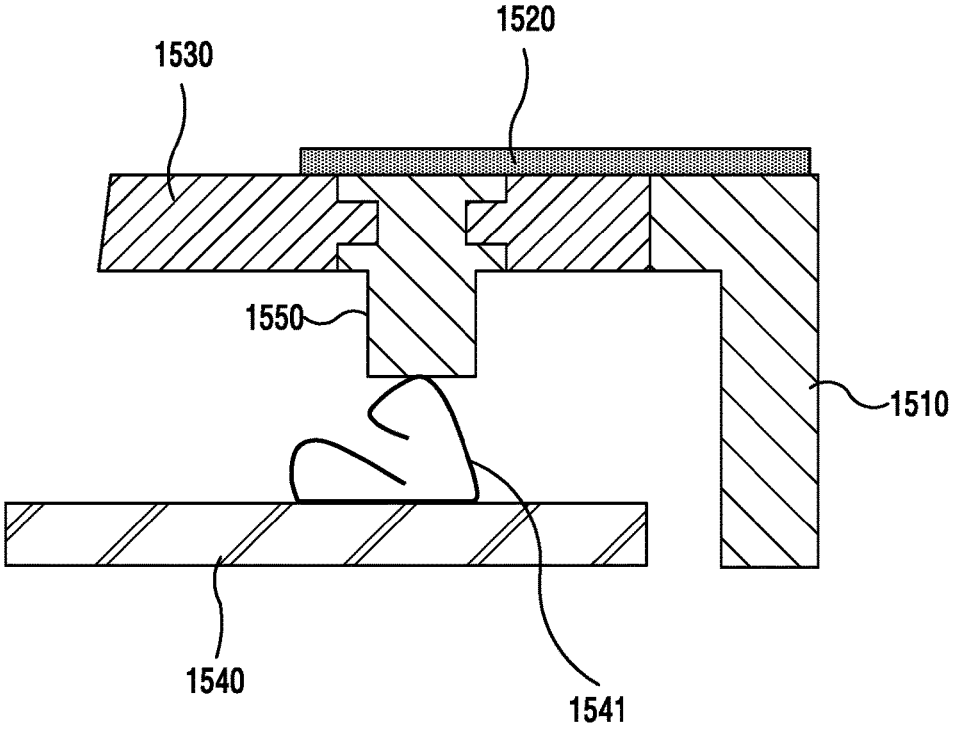

Referring to FIG. 15, a first antenna member 1510 that serves as a part of a metal bezel and a housing 1530 are integrally formed with each other, and the first antenna member 1510 and a portion through which a metal part 1550 is exposed among the outer surface of the housing 1530 are electrically connected to each other by a second antenna member 1520. In this case, the second antenna member 1520 may establish an electrical connection by the metal part 1550 through an electrical connection member 1541 mounted on a PCB 1540. In this case, the first and second antenna members 1510 and 1520 may be used as monopole antenna radiators.

Figure 16:
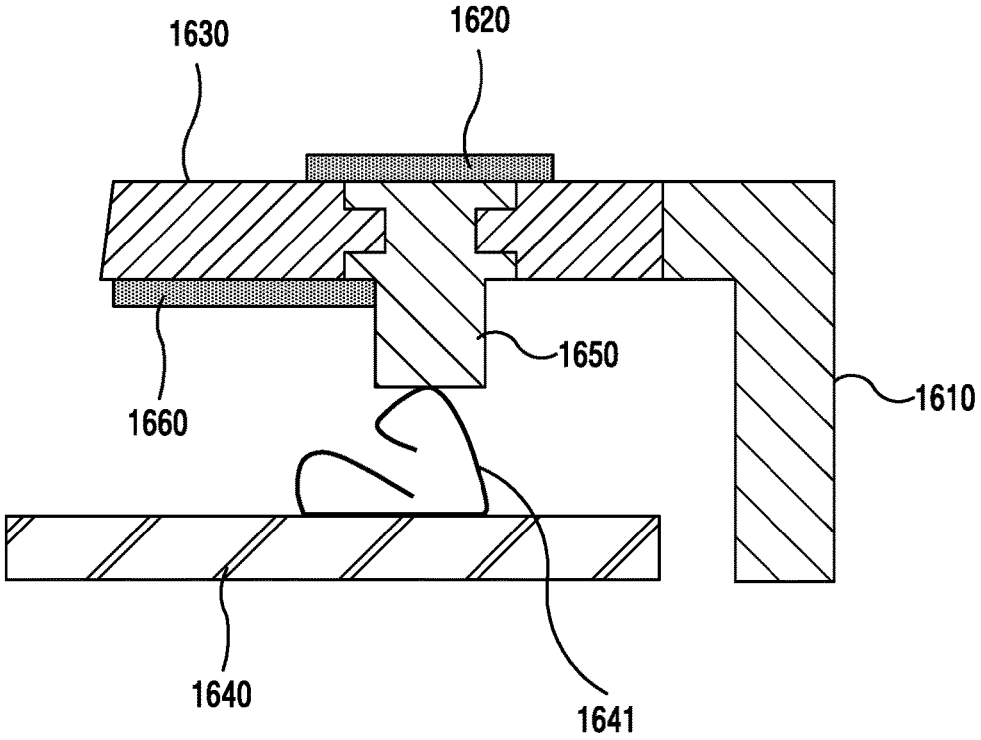

Referring to FIG. 16, a first antenna member 1610 that serves as a part of a metal bezel and a housing 1630 are integrally formed with each other, and a second antenna member 1620 is disposed on a portion through which a metal part 1650 is exposed among the outer surface of the housing 1630. In addition, a third antenna member 1660 is disposed on the inner surface of the housing 1630 through which the metal part 1650 is exposed. In this case, the second and third antenna members 1620 and 1660 may establish an electrical connection by the metal part 1650 through an electrical connection member 1641 mounted on a PCB 1640 to serve as a single antenna member. The first antenna member 1610 may also independently operate as an antenna radiator, or may serve as an extended ground area through coupling with the second and third antenna members 1620 and 1660.

Figure 17:
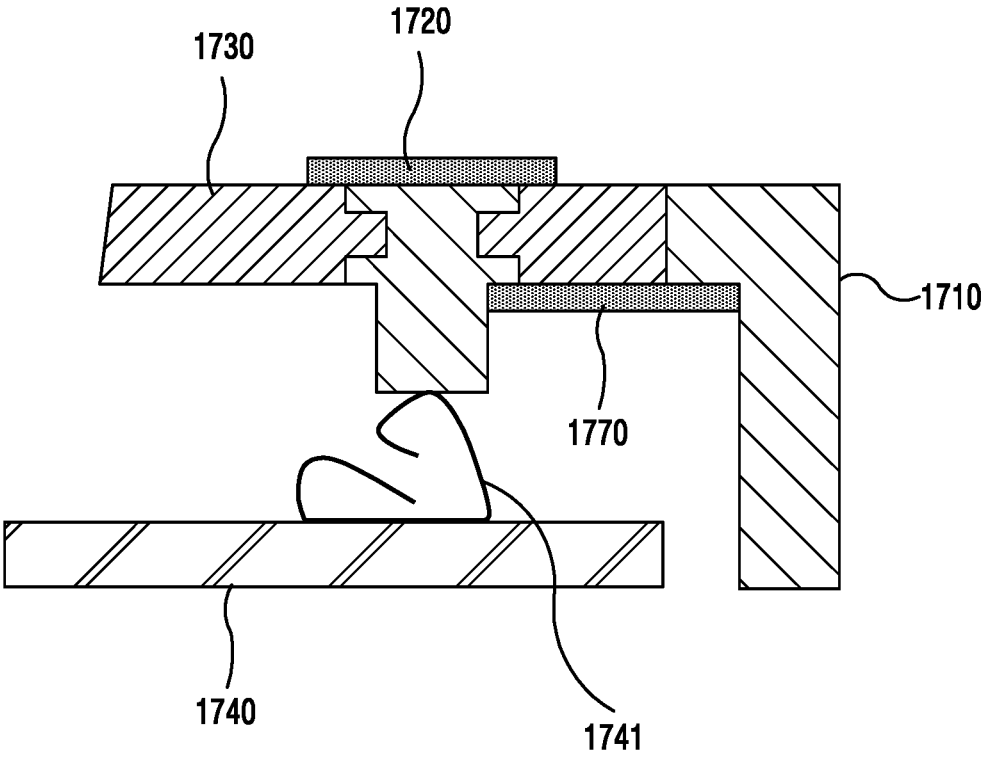

Referring to FIG. 17, a first antenna member 1710 that serves as a part of a metal bezel and a housing 1730 are integrally formed with each other, and a second antenna member 1720 is disposed on a portion through which a metal part 1750 is exposed among the outer surface of the housing 1730. In addition, a third antenna member 1770 is disposed on the inner surface of the housing 1730 through which the metal part 1750 is exposed. In this case, the third antenna member 1770 may be electrically connected to the first antenna member 1710. The second and third antenna members 1720 and 1770 and the first antenna member 1710, which is electrically connected to the third antenna member 1770, may establish an electrical connection by the metal part 1050 through an electrical connection member 1741 mounted on a PCB 1740 to serve as a single antenna member. The second and third antenna members 1720 and 1770 may be used as extended antenna radiators through the electrical connection with the first antenna member 1710.

Figure 18:
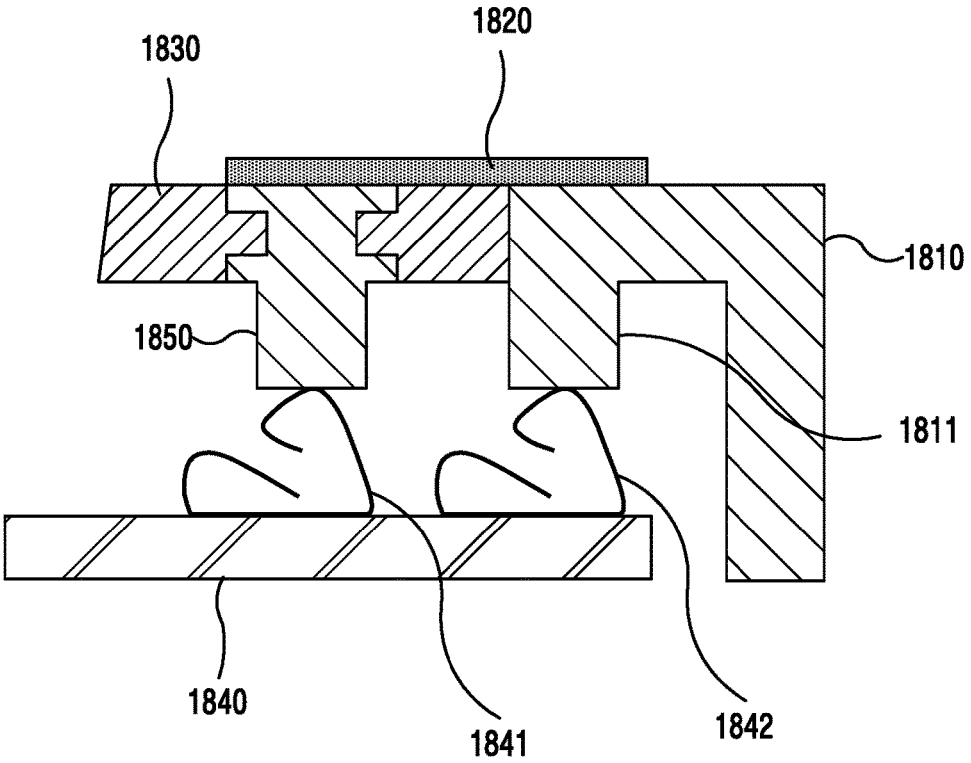

Referring to FIG. 18, a first antenna member 1810 that serves as a part of a metal bezel and a housing 1830 are integrally formed with each other, and a second antenna member 1820 is disposed on a portion through which a metal part 1850 is exposed among the outer surface of the housing 1830. The second antenna member 1820 electrically connects the metal part 1850 and the first antenna member 1810. The second antenna member 1820 establishes an electrical connection by the metal part 1850 through an electrical connection member 1841 mounted on a PCB 1840. The first antenna member 1810 may also establish an electrical connection by a connection rib 1811, which extends toward the housing 1830, through an electrical connection member 1842 mounted on the PCB 1840.

Figure 19:
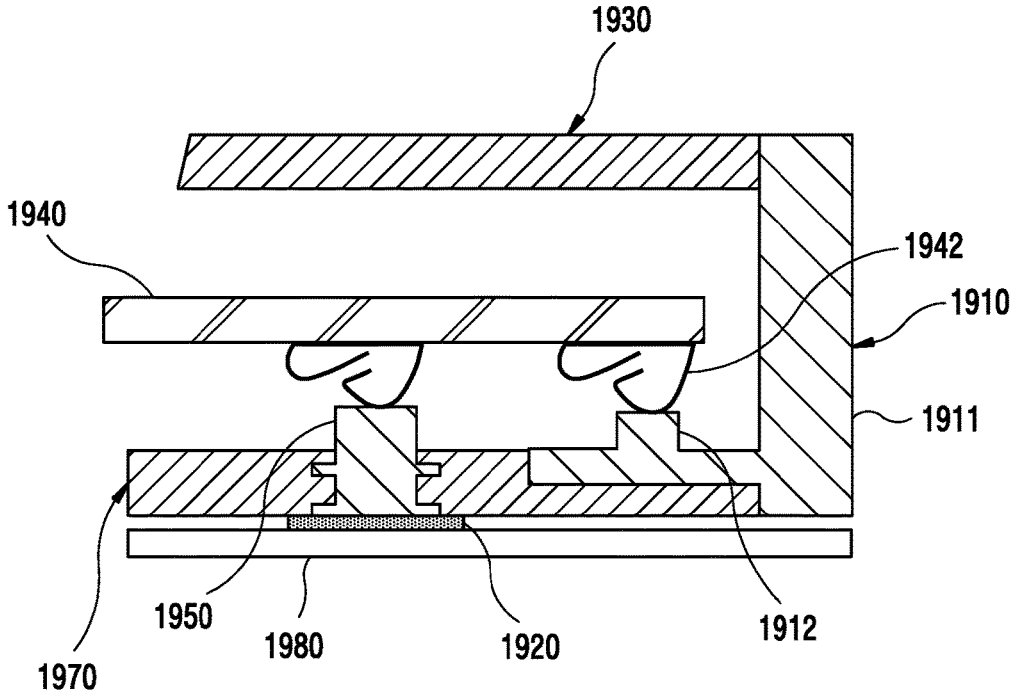

Referring to FIG. 19, a first antenna member 1911 that serves as a part of a metal bezel 1910 and a housing 1970 are integrally formed with each other, and a second antenna member 1920 is disposed on a portion through which a metal part 1950 is exposed among the outer surface of the housing 1970.

The housing 1930 may serve as a rear housing, and the other housing 1970 may serve as a front housing. In this case, the second antenna member 1920 may also be disposed on a portion through which the first antenna member 1911 is exposed among the outer surface of the front housing 1970.

The second antenna member 1920 is disposed on a window 1980 that faces the front housing 1970. In this case, the second antenna member 1920 may be attached to the window 1980, e.g., by bonding, taping, etc.

The second antenna member 1920 may be disposed in a Black Mask (BM) area of the window 1980.

When the window 1980 is mounted on the front housing 1970, the second antenna member 1920 disposed on the rear surface of the housing 1970 may be electrically connected to the first antenna member 1911, which is exposed through the front housing, by a natural surface-to-surface contact therebetween.

The second antenna member 1920 is electrically connected to a PCB 1940 by the metal part 1950. The second antenna member 1920 establishes an electrical connection by the metal part 1950 through an electrical connection member 1941 mounted on the PCB 1940.

The first antenna member 1910 may also establish an electrical connection by a connection rib 1912, which extends toward the PCB 1940, through an electrical connection member 1942 mounted on the PCB 1940.

Figure 20:
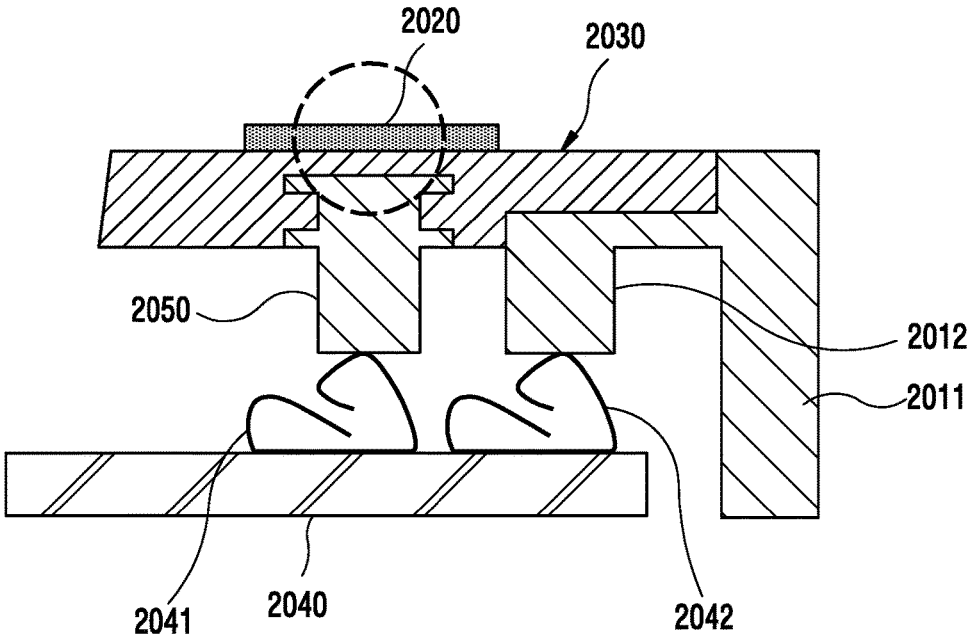
Figure 21:
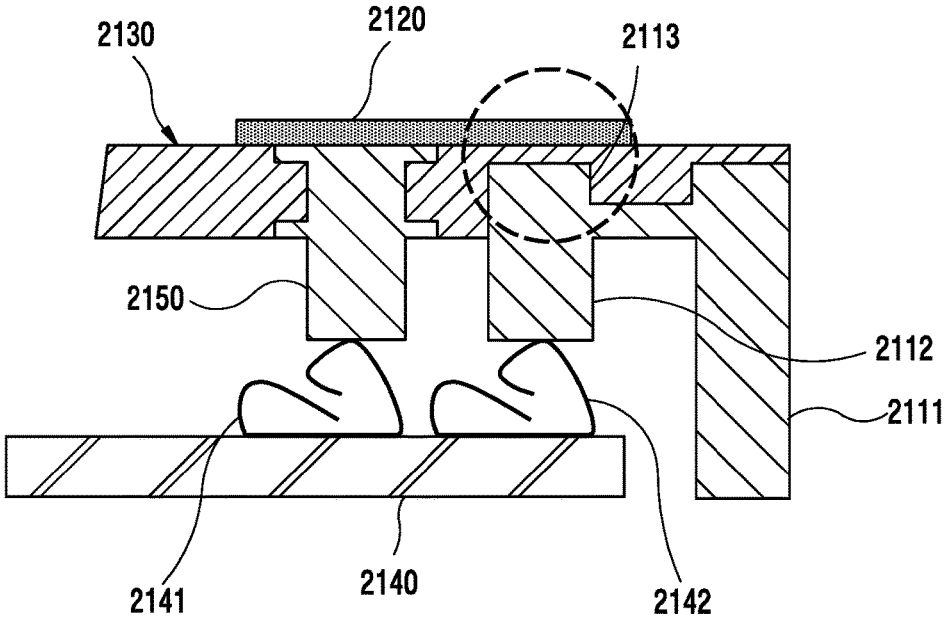
Figure 22:
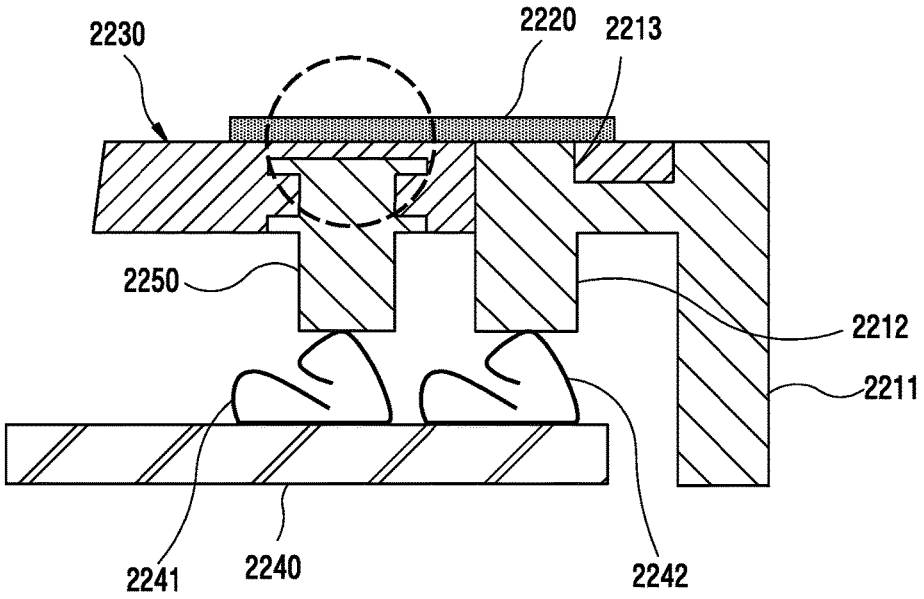

FIGS. 20 to 22 illustrate a metal part or a first antenna member that is electrically connected to a PCB through non-contact coupling with a second antenna member, according to embodiments of the present disclosure. Hereinafter, descriptions of the same elements illustrated in FIGS. 14-19 will be omitted.

Referring to FIG. 20, a metal part 2050 is injection-molded such that at least a part thereof is not completely exposed through a housing 2030, and a second antenna member 2020 is disposed near the un-exposed portion to perform a coupling operation. Accordingly, the first and second antenna members 2011 and 2020 may also operate as independent antenna radiators. The second antenna member 2020 establishes an electrical connection by the metal part 2050 through an electrical connection member 2041 mounted on a PCB 2040. The first antenna member 2011 may also establish an electrical connection by a connection rib 2012, which extends toward the housing 1830, through an electrical connection member 2042 mounted on the PCB 2040.

Referring to FIG. 21, a metal part 2150 physically contacts a second antenna member 2120. A connection rib 2113 of a first antenna member 2111 is injection-molded so as to not be completely exposed through a housing 2130, and the second antenna member 2120 is disposed near the un-exposed portion to perform a coupling operation. The second antenna member 2120 establishes an electrical connection by the metal part 2150 through an electrical connection member 2141 mounted on a PCB 2140. The first antenna member 2111 may also establish an electrical connection by a connection rib 2112, which extends toward the housing 2130, through an electrical connection member 2142 mounted on the PCB 2140.

Referring to FIG. 22, a metal part 2250 is injection-molded such that at least a part thereof is not completely exposed through a housing 2230, and a second antenna member 2220 is disposed near the un-exposed portion to perform a coupling operation. The second antenna member 2220 physically contacts a first antenna member 2211 exposed through the housing 2230.

The above-described coupling structure may be more advantageous when the housing 2230 serves as an external housing of an electronic device, and the second antenna member 2220 is a metal ornament that is applied to the external housing. The second antenna member 2220 establishes an electrical connection by the metal part 2250 through an electrical connection member 2241 mounted on a PCB 2240. The first antenna member 2211 may also establish an electrical connection by a connection rib 2212, which extends toward the housing 2230, through an electrical connection member 2242 mounted on the PCB 2240.

Figure 23A:
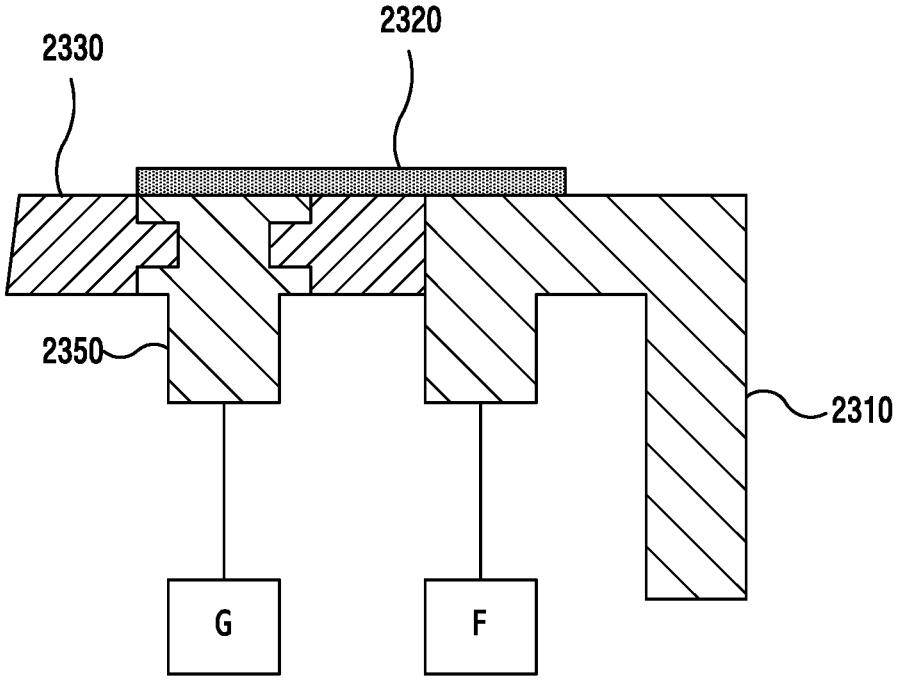
FIGS. 23A to 23C illustrate power-feed and ground conditions of an antenna device, according to an embodiment of the present disclosure.
Figure 23B:
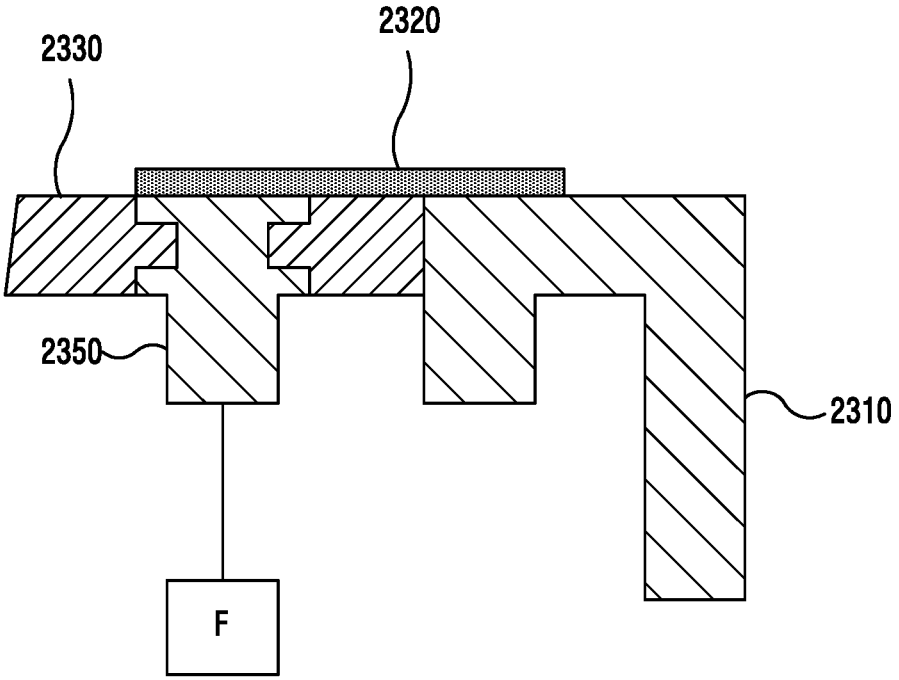
Figure 23C:
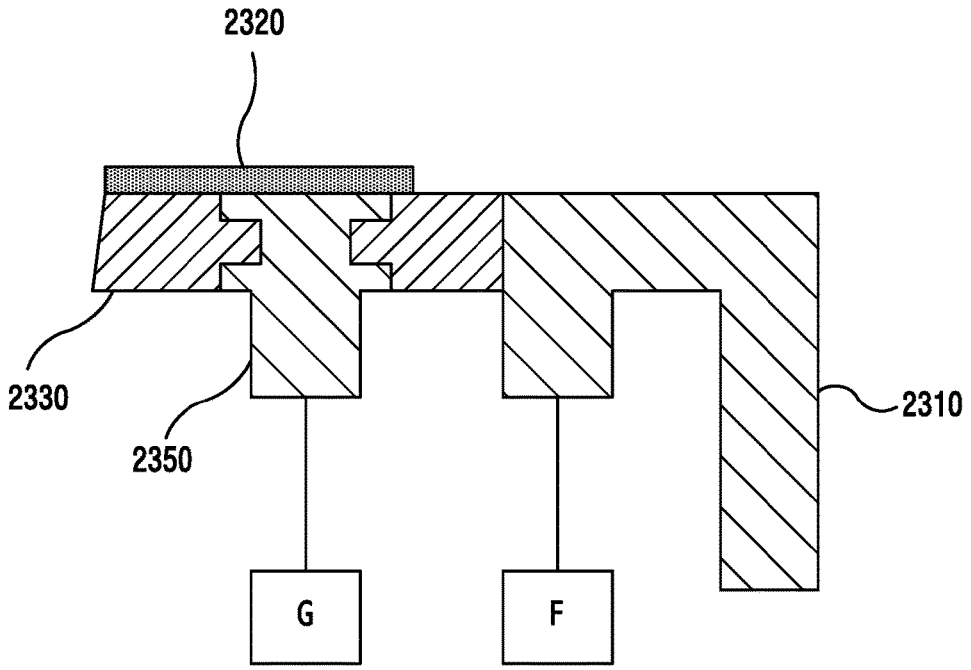
Figure 24A:
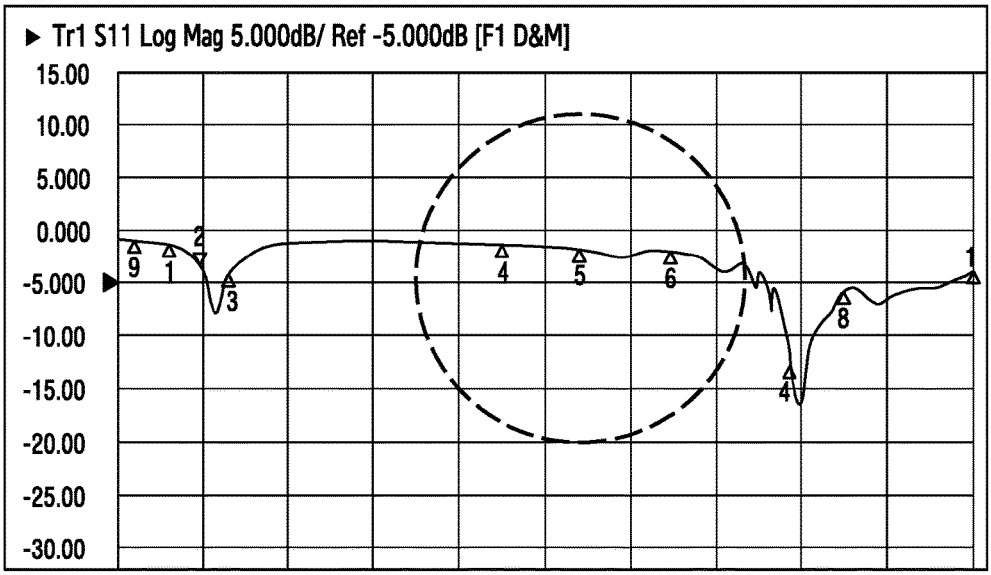
FIGS. 24A to 24D are graphs illustrating radiation properties of a first antenna member before a second antenna member is connected thereto and radiation properties of an antenna device in which the second antenna member is connected to the first antenna member, according to an embodiment of the present disclosure.
Figure 24B:
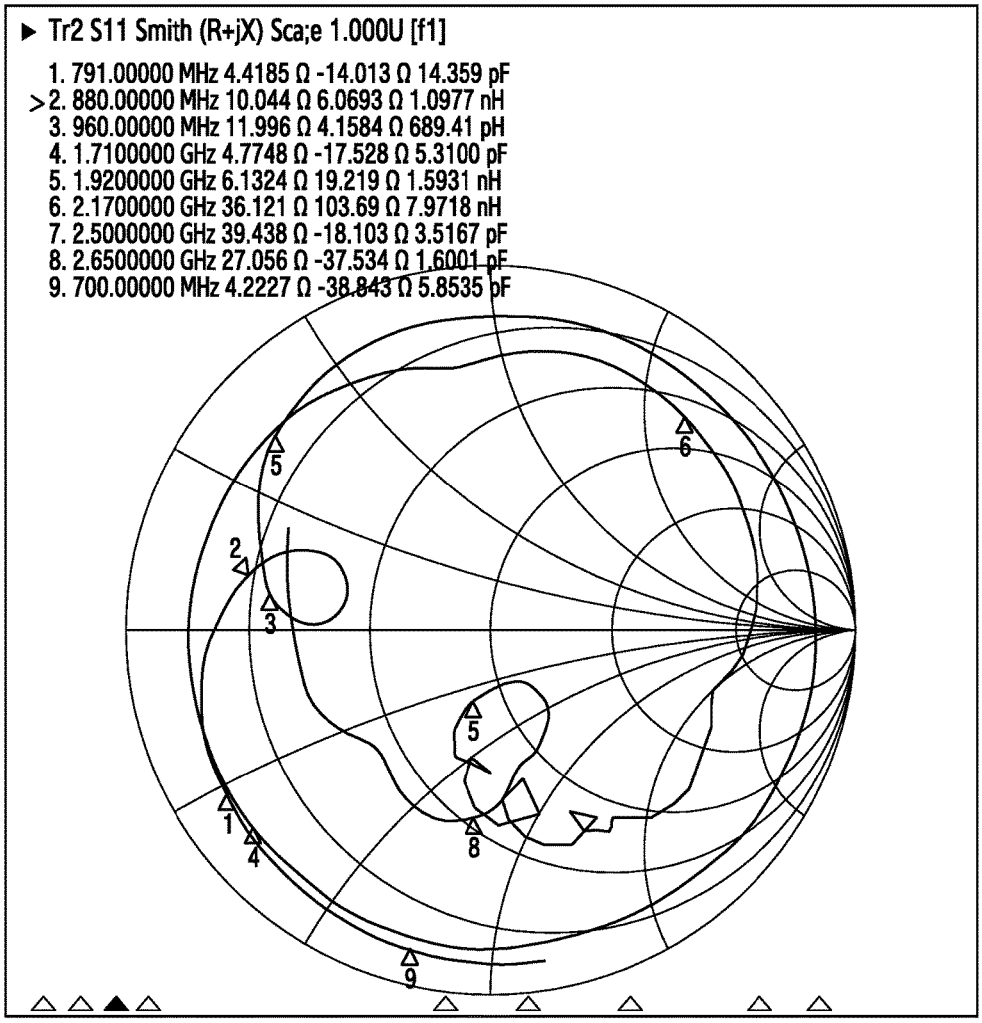
Figure 24C:
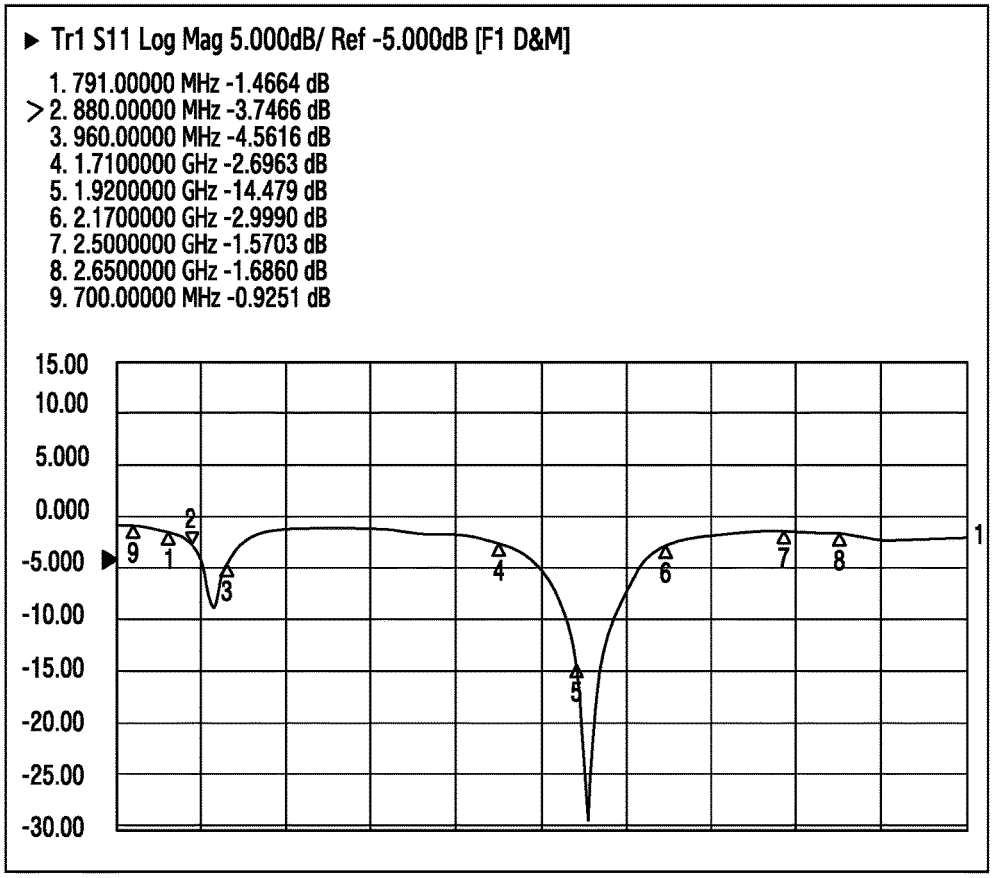
Figure 24D:
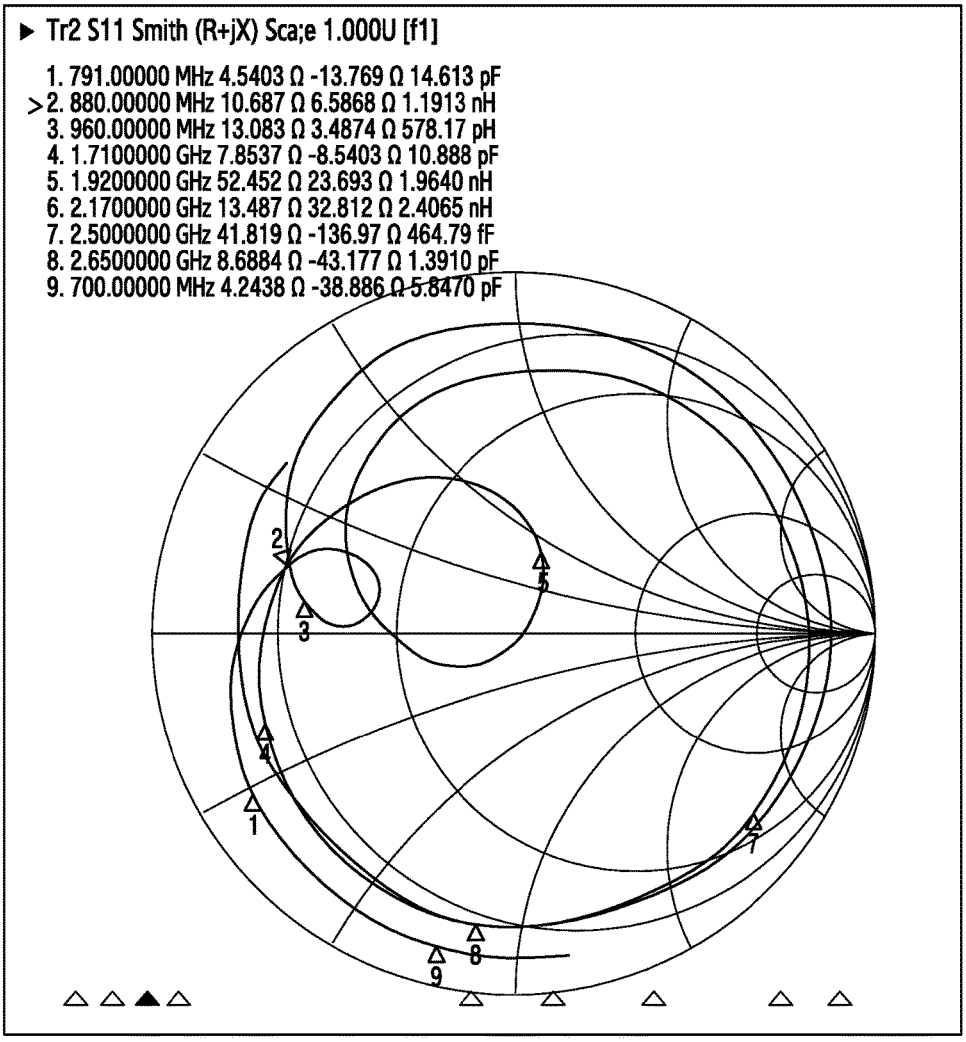

FIGS. 23A to 23C illustrate power-feed and ground conditions of an antenna device, according to various embodiments of the present disclosure.

Referring to FIG. 23A, a first antenna member 2310 that serves as a part of a metal bezel and a housing 2330 are integrally formed with each other, and a second antenna member 2320 is disposed on a portion through which a metal part 2350 is exposed among the outer surface of the housing 2330. The second antenna member 2320 may electrically connect the metal part 2350 and the first antenna member 2310. The second antenna member 2320 may be electrically grounded by the metal part 2350 through an electrical connection member mounted on a PCB. The first antenna member 2310 may also be electrically fed by a connection rib, which extends toward the housing, through an electrical connection member mounted on the PCB. In this case, the first and second antenna members 2310 and 2320 may operate as Planar Inverted-F Antennas (PIFAs).

Referring to FIG. 23B, the first antenna member 2310 that serves as a part of a metal bezel and the housing 2330 are integrally formed with each other, and the first antenna member 2310 and a portion through which the metal part 2350 is exposed among the outer surface of the housing 2330 are electrically connected to each other by the second antenna member 2320. In this case, the second antenna member 2320 may be fed by the metal part 2350 through an electrical connection member mounted on a PCB. In this case, the first and second antenna members 2310 and 2320 may be used as monopole antenna radiators.

Referring to FIG. 23C, the first antenna member 2310 that serves as a part of a metal bezel and the housing 2330 are integrally formed with each other, and a second antenna member 2325 is disposed on a portion through which the metal part 2350 is exposed among the outer surface of the housing 2330. The second antenna member 2325 may be electrically grounded by the metal part 2350 through an electrical connection member mounted on a PCB. The first antenna member 2310 may also be electrically fed by a connection rib, which extends toward the housing, through an electrical connection member mounted on the PCB. Because the first and second antenna members 2310 and 2325 are electrically isolated from each other in this case, the second antenna member 2325 may operate as a ground stub for extending the bandwidth of the first antenna member 2310 or adjusting (tuning) the frequency of the first antenna member 2310.

FIGS. 24A to 24D are graphs illustrating radiation properties of a first antenna member before a second antenna member is connected thereto and radiation properties of an antenna device in which the second antenna member is connected to the first antenna member, according to an embodiment of the present disclosure.

Referring to FIGS. 24A to 24D, when the second antenna member is applied as an extension antenna radiator to the first antenna member, a frequency shift to a desired band is observed in the graph S11, and matching over the desired band on the smith chart is achieved.

According to various embodiments, an antenna device that includes a first antenna member for which at least a part of a metal structure of an electronic device is applied as an antenna member and a second antenna member connected thereto can make impedance matching and an antenna resonance shift to a desired band possible. For example, a multi-band broadband antenna may be constituted by configuring a low-band with the first antenna member (i.e., a metal frame) and a high-band with multiplication equipment and by using the second antenna member (i.e., an extension antenna pattern).

Figure 25A:
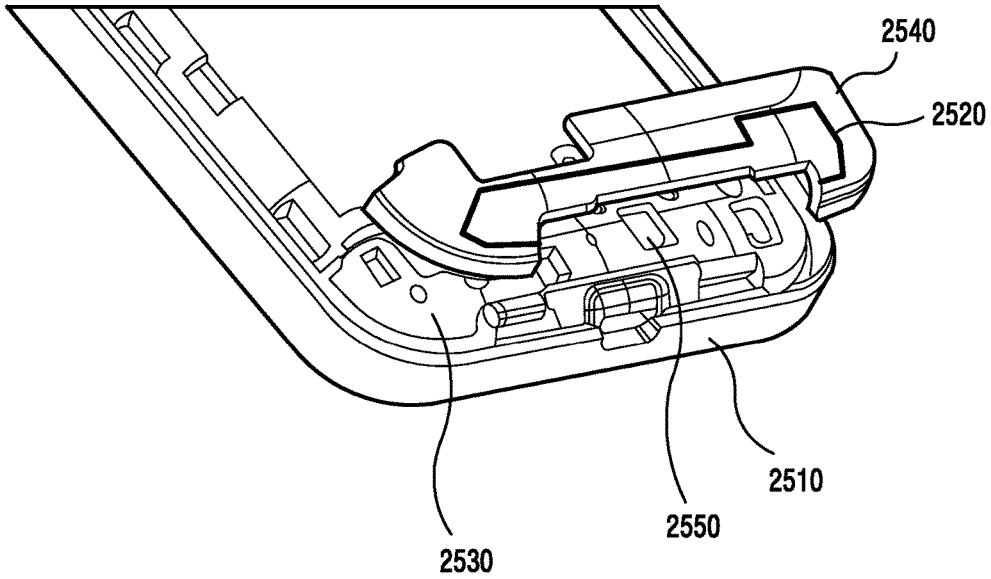
FIGS. 25A to 25C illustrate a second antenna member applied to an antenna carrier, according to various embodiments of the present disclosure.
Figure 25B:
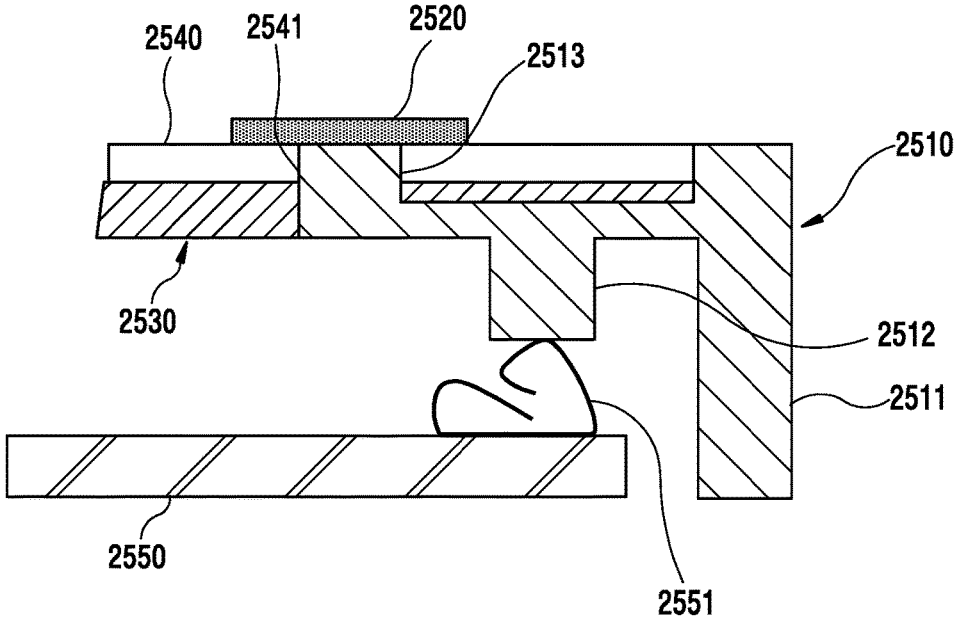
Figure 25C:
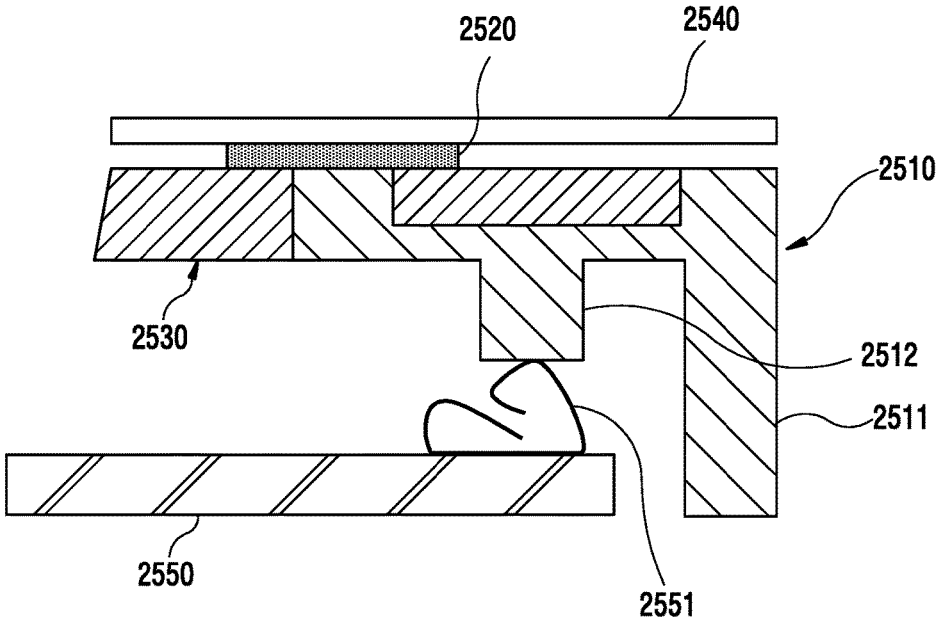

FIGS. 25A to 25C illustrate a second antenna member applied to an antenna carrier, according to various embodiments of the present disclosure.

Referring to FIG. 25A, a second antenna member 2520 is disposed on an antenna carrier 2540 that is provided on a housing 2530 of the electronic device. The second antenna member 2520 may be formed on the inner or outer surface of the antenna carrier 2540 by an LDS method or an IMA method, or may be formed by attaching at least one of an FPCB having a thin metal plate or pattern formed thereon and a metal tape to the outer or inner surface of the antenna carrier 2540, by applying a conductive spray to the inner or outer surface of the antenna carrier 2540, or by insert molding or double injection molding in such a manner as to be exposed, or not to be exposed, through the inner or outer surface of the antenna carrier 2540. The second antenna member 2520 may be electrically connected to a metal part 2550 that is exposed through the rear surface of the housing 2530 of the electronic device when the antenna carrier 2540 is coupled to the housing 2530.

Although the second antenna member 2520 is illustrated as being applied to the antenna carrier 2540, the second antenna member 2520 may also be applied to a housing or various types of covers (e.g., a battery pack cover), which constitute an electronic device, in the same manner that the second antenna member is applied to the antenna carrier 2540.

Referring to FIG. 25B, the first antenna member 2511 that serves as a part of the metal bezel 2510 has a connection rib 2513 extending toward the housing 2530. The connection rib 2513 may be injection-molded such that a part thereof protrudes from the housing 2530. The protruded connection rib 2513 may be inserted into an opening 2541 of the antenna carrier 2540 mounted on the housing 2530 and may be exposed through the outer surface of the antenna carrier 2540. The second antenna member 2520 is disposed on, and electrically connected to, a portion of the antenna carrier 2540 that corresponds to the exposed connection rib 2513.

A protruding rib 2512 extending downward from the connection rib 2513 may be physically and electrically connected to the PCB 2550 by an electrical connection member 2551 mounted on the PCB 2550. Accordingly, the first antenna member 2511 may be electrically connected to the second antenna member 2520 while passing through the antenna carrier 2540.

Referring to FIG. 25C, the first antenna member 2511 that is part of the metal bezel 2510 is injection-molded such that a part thereof is exposed through the housing 2530. The second antenna member 2520 is disposed on the inner surface of the antenna carrier 2540. Accordingly, when the antenna carrier 2540 is mounted on the housing 2530, the second antenna member 2520 on the inner surface of the antenna carrier 2540 physically contacts the first antenna member 2511 exposed through the housing 2530.

Figure 26A:
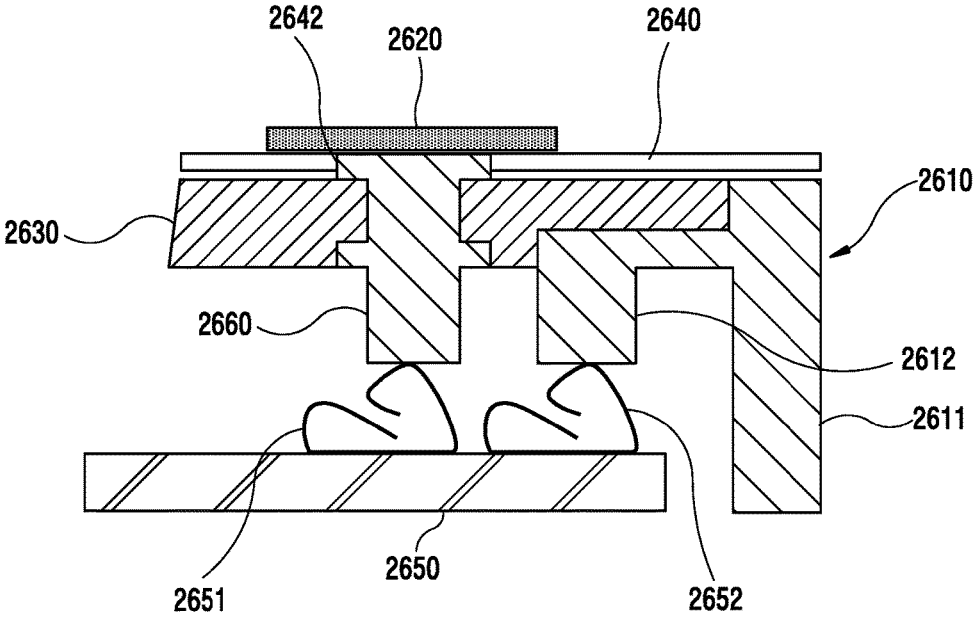
FIGS. 26A to 26B illustrate a second antenna member applied to an antenna carrier, according to various embodiments of the present disclosure.
Figure 26B:
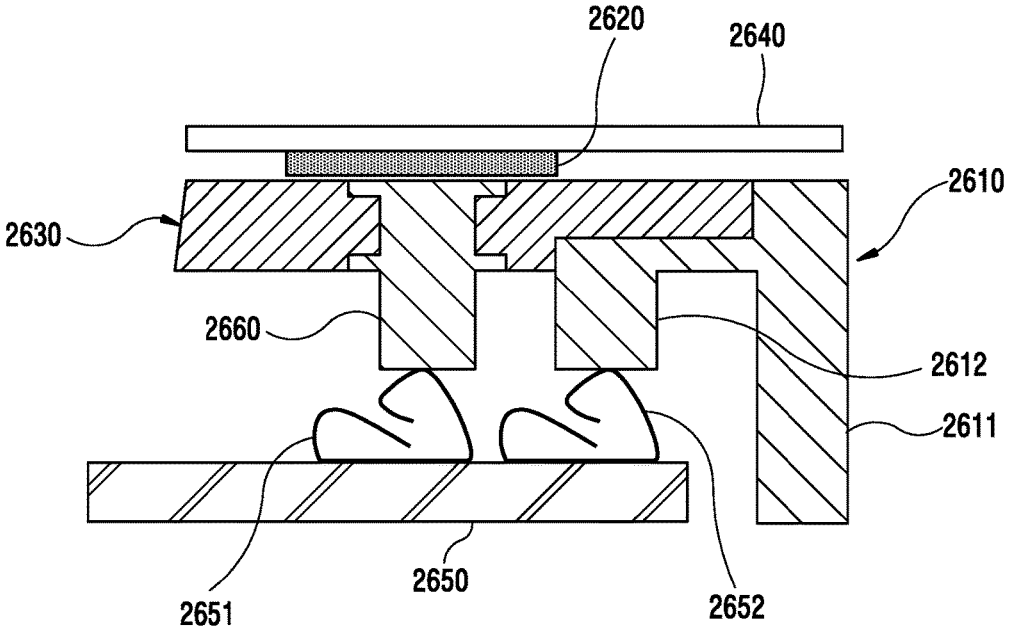

Referring to FIGS. 26A and 26B, a second antenna member 2620 is applied to a housing 2630 when a metal part 2660 is used.

Referring to FIG. 26A, the metal part 2660 may be injection-molded such that a portion of the upper side thereof protrudes from the housing 2630, and the protruded portion may be inserted into an opening 2642 formed in an antenna carrier 2640. The metal part 2660 inserted into the antenna carrier 2640 may be exposed through the outer surface of the antenna carrier 2640, and the second antenna member 2620 may be disposed on the exposed metal part 2660 so that the metal part 2660 and the second antenna member 2620 are electrically connected to each other.

Referring to FIG. 26B, the metal part 2660 may be injection-molded such that a portion of the upper side thereof is exposed through the housing 2630. The second antenna member 2620 is disposed on the inner surface of an antenna carrier 2640. Accordingly, when the antenna carrier 2640 is mounted on the housing 2630, the second antenna member 2620 on the inner surface of the antenna carrier 2640 physically contacts the first antenna member 2611 exposed through the housing 2630.

According to the various embodiments of the present disclosure, a metal member used as an antenna device can be electrically connected to an antenna radiator to configure a multi-band together so that an additional mounting space on a PCB is not required. In addition, various connection conditions can be made according to a portion of the exposed outer surface of the metal member, and separate components or additional processes are not required so that an error and a deviation due to additional processing can be excluded, thereby stabilizing the radiation performance of an antenna device.

Figure 27:
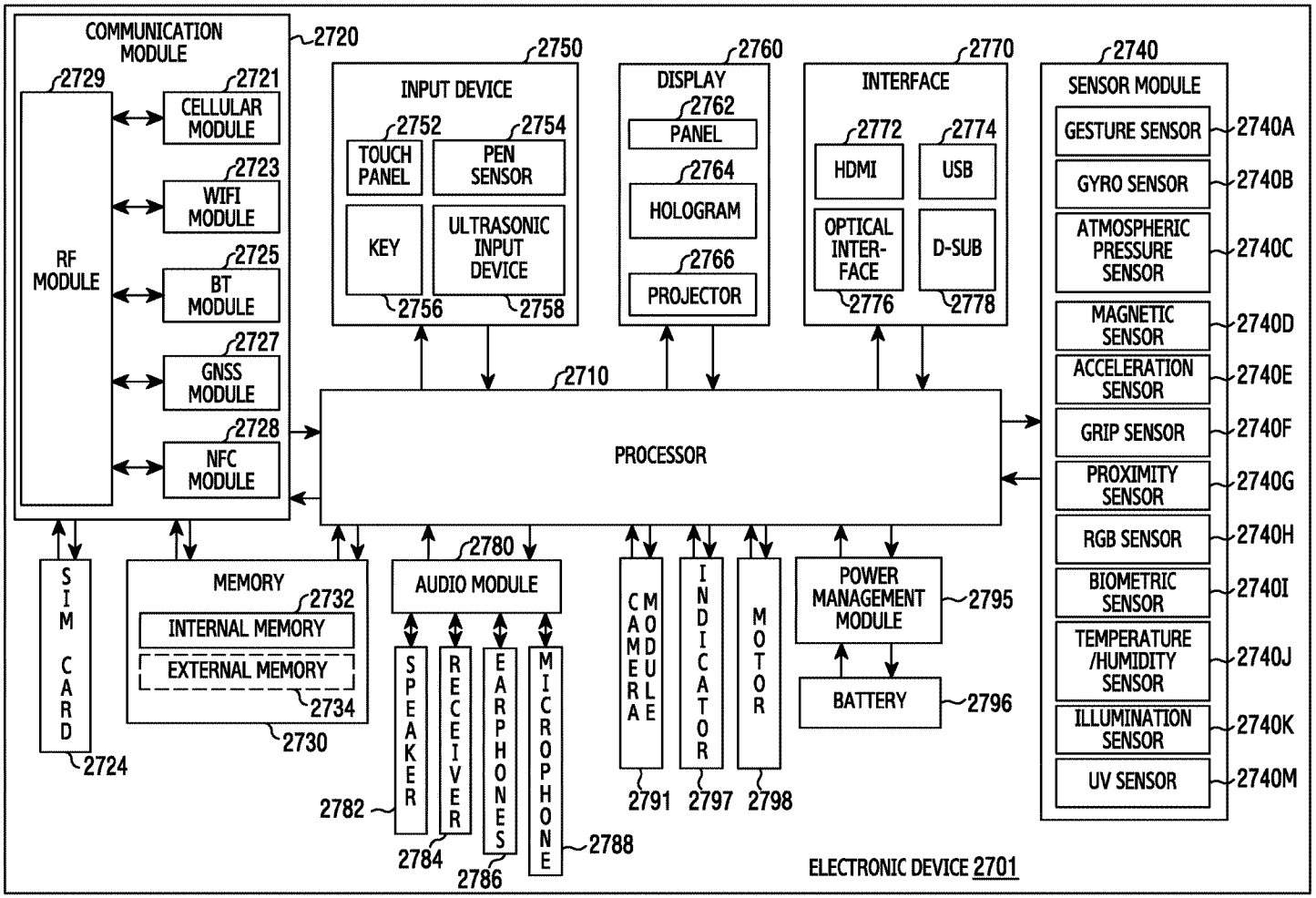
FIG. 27 illustrates an electronic device according to an embodiment of the present disclosure.

FIG. 27 illustrates an electronic device according to an embodiment of the present disclosure.

Referring to FIG. 27, the electronic device 2701 includes a processor 2710, a communication module 2720, a subscriber identification module (SIM) card 2724, a memory 2730, a sensor module 2740, an input device 2750, a display 2760, an interface 2770, an audio module 2780, a camera module 2791, a power management module 2795, a battery 2796, an indicator 2797, and a motor 2798.

The processor 2710 controls a plurality of hardware or software elements connected to the processor 2710 by driving an OS or an application program. The processor 2710 processes a variety of data, including multimedia data, and performs arithmetic operations. The processor 2710 may be implemented with a system on chip (SoC). The processor 2710 may further include a Graphical processing unit (GPU).

The communication module 2720 performs data transmission/reception in communication between an external electronic device or a server that may be connected with the electronic device 2701 through a network. The communication module 2720 includes a cellular module 2721, a Wi-Fi module 2723, a BT module 2725, a global navigation satellite system (GNSS) or GPS module 2727, a Near field communication (NFC) module 2728, and a radio frequency (RF) module 2729.

The cellular module 2721 provides a voice call, a video call, a text service, an internet service, etc., through a communication network (e.g., LTE, LTE-A, CDMA, WCDMA, UMTS, WiBro, and GSM, etc.). In addition, the cellular module 2721 identifies and authenticates the electronic device 2701 within the communication network by using the SIM card 2724. The cellular module 2721 may perform at least some of functions that can be provided by the processor 2710. For example, the cellular module 2721 may perform at least some of multimedia control functions.

The cellular module 2721 includes a CP. Further, the cellular module 2721 may be implemented with an SoC. Although elements, such as the cellular module 2721 (e.g., the CP), the memory 2730, and the power management module 2795 are illustrated as separate elements with respect to the processor 2710 in FIG. 27, the processor 2710 may also be implemented such that at least one part (e.g., the cellular module 2721) of the aforementioned elements is included in the processor 2710.

The processor 2710 or the cellular module 2721 loads an instruction or data, which is received from each non-volatile memory connected thereto or at least one of different elements, to a volatile memory, and processes the instruction or data. In addition, the processor 2710 or the cellular module 2721 stores data, which is received from at least one of different elements or generated by at least one of different elements, into the non-volatile memory.

Each of the Wi-Fi module 2723, the BT module 2725, the GNSS module 2727, and the NFC module 2728 includes a processor for processing data transmitted/received through a corresponding module. Although the cellular module 2721, the Wi-Fi module 2723, the BT module 2725, the GNSS module 2727, and the NFC module 2728 are illustrated in FIG. 27 as separate blocks, at least some (e.g., two or more) of the cellular module 2721, the Wi-Fi module 2723, the BT module 2725, the GNSS module 2727, and the NFC module 2728 may be included in one integrated chip (IC) or IC package. For example, at least some of processors corresponding to the cellular module 2721, the Wi-Fi module 2723, the BT module 2725, the GNSS module 2727, and the NFC module 2728 (e.g., a communication processor corresponding to the cellular module 2721 and a Wi-Fi processor corresponding to the Wi-Fi module 2723) may be implemented with an SoC.

The RF module 2729 transmits/receives data, for example, an RF signal. The RF module 2729 may include a transceiver, a power amp module (PAM), a frequency filter, a low noise amplifier (LNA), etc. In addition, the RF module 2729 may further include a component for transmitting/receiving a radio wave on a free space in wireless communication, e.g., a conductor, a conducting wire, etc. Although FIG. 27 illustrates the cellular module 2721, the Wi-Fi module 2723, the BT module 2725, the GNSS module 2727, and the NFC module 2728 sharing the RF module 2729, a at least one of the cellular module 2721, the Wi-Fi module 2723, the BT module 2725, the GNSS module 2727, the NFC module 2728 may transmit/receive an RF signal via a separate RF module.

The SIM card 2724 may be inserted into a slot formed at a specific location of the electronic device 2701. The SIM card 2724 includes unique identification information (e.g., an integrated circuit card identifier (ICCID)) or subscriber information (e.g., an international mobile subscriber identity (IMSI)).

The memory 2730 includes an internal memory 2732 and an external memory 2734.

The internal memory 2732 may include at least one of a volatile memory (e.g., a dynamic random access memory (DRAM), a static RAM (SRAM), a synchronous dynamic RAM (SDRAM), etc.) or a non-volatile memory (e.g., a programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, etc.). The internal memory 2732 may be a solid state drive (SSD).

The external memory 2734 may include a flash drive, and may further include a compact flash (CF), secure digital (SD), micro-SD, mini-SD, extreme digital (xD), a memory stick, etc. The external memory 2734 may be operatively coupled to the electronic device 2701 via various interfaces.

The electronic device 2701 may further include a storage unit (or a storage medium), such as a hard drive.

The sensor module 2740 measures a physical quantity or detects an operation state of the electronic device 2701, and converts the measured or detected information into an electric signal. The sensor module 2740 includes a gesture sensor 2740A, a gyro sensor 2740B, a barometric pressure sensor or air sensor 2740C, a magnetic sensor 2740D, an acceleration sensor 2740E, a grip sensor 2740F, a proximity sensor 2740G, a color sensor 740H (e.g., a red, green, blue (RGB) sensor), a biometric sensor 27401, a temperature/humidity sensor 2740J, an illumination/illuminance sensor 2740K, and an ultraviolet (UV) sensor 2740M.

Additionally or alternatively, the sensor module 2740 may include an E-node sensor, an electromyography (EMG) sensor, an electroencephalogram (EEG) sensor, an electrocardiogram (ECG) sensor, a fingerprint sensor, etc.

The sensor module 2740 may further include a control circuit for controlling at least one or more sensors included therein.

The input device 2750 includes a touch panel 2752, a (digital) pen sensor 2754, a key 2756, and an ultrasonic input unit 2758.

The touch panel 2752 recognizes a touch input by using at least one of an electrostatic type configuration, a pressure-sensitive type configuration, and an ultrasonic type configuration. The touch panel 2752 may further include a control circuit. When the touch panel is an electrostatic type, physical contact recognition and proximity recognition are possible. The touch penal 2752 may further include a tactile layer, which provides the user with a tactile reaction.

The (digital) pen sensor 2754 may include a recognition sheet which is a part of the touch panel or is separated from the touch panel.

The key 2756 may include a physical button, an optical key, a keypad, or a touch key.

The ultrasonic input device 2758 may detect ultrasonic waves generated by an input tool through the microphone 2788, and may confirm data corresponding to the detected ultrasonic waves. For example, an ultrasonic signal, which may be generated by using a pen, may be reflected off an object and detected by the microphone 2788.

The electronic device 2701 may use the communication module 2720 to receive a user input from an external device (e.g., a computer or a server) connected thereto. The display 2760 includes a panel 2762, a hologram device 2764, and a projector 2766.

The panel 2762 may be a liquid-crystal display (LCD), an active-matrix organic light-emitting diode (AM-OLED), etc. The panel 2762 may be implemented in a flexible, transparent, and/or wearable manner. The panel 2762 may be constructed as one module with the touch panel 2752.

The hologram device 2764 uses an interference of light and displays a stereoscopic image in the air.

The projector 2766 displays an image by projecting a light beam onto a screen. The screen may be located inside or outside the electronic device 2701.

The display 2760 may further include a control circuit for controlling the panel 2762, the hologram device 2764, and/or the projector 2766.

The interface 2770 includes an HDMI 2772, a USB 2774, an optical communication interface 2776, and a D-subminiature (D-sub) 2778. Additionally or alternatively, the interface 2770 may include mobile high-definition link (MHL), SD/multi-media card (MMC) and/or infrared data association (IrDA).

The audio module 2780 bilaterally converts a sound and an electric signal. The audio module 2780 converts sound information which is input or output through a speaker 2782, a receiver 2784, an earphone 2786, the microphone 2788, etc.

The speaker 2782 may output a signal of an audible frequency band and a signal of an ultrasonic frequency band. Reflected waves of an ultrasonic signal emitted from the speaker 2782 may be received, or a signal of an external audible frequency band may also be received.

The camera module 2791 is a device for image and video capturing, and may include one or more image sensors (e.g., a front sensor or a rear sensor), a lens, an image signal processor (ISP), or a flash (e.g., an LED or a xenon lamp). In certain instances, it may prove advantageous to include two or more camera modules.

The power management module 2795 manages power of the electronic device 2701. The power management module 2795 may include a power management integrated circuit (PMIC), a charger IC, or a battery gauge.

The PMIC may be placed inside an IC or an SoC semiconductor. Charging is generally classified into wired charging and wireless charging. The charger IC charges a battery, and prevents an over-voltage or over-current flow from a charger. The charger IC includes a charger IC for at least one of the wired charging and the wireless charging.

For example, the wireless charging may include a magnetic resonance type, a magnetic induction type, or an electromagnetic type of charging. An additional circuit for the wireless charging, for example, a coil loop, a resonant circuit, a rectifier, etc., may be added.

The battery gauge may measure a residual quantity of the battery 2796 and a voltage, current, and temperature during charging.

The battery 2796 stores or generates electricity and supplies power to the electronic device 2701 by using the stored or generated electricity. The battery 2796 may include a rechargeable battery or a solar battery.

The indicator 2797 indicates a specific state, for example, a booting state, a message state, a charging state, etc., of the electronic device 2701 or a part thereof (e.g., the processor 2710).

The motor 2798 converts an electric signal into a mechanical vibration.

The electronic device 2701 may include a processing unit (e.g., a GPU) for supporting mobile TV. The processing unit for supporting mobile TV may process media data according to a protocol, such as digital multimedia broadcasting (DMB), digital video broadcasting (DVB), media flow, etc.

Each of the aforementioned elements of the electronic device 2701 may consist of one or more components, and names thereof may vary depending on a type of the electronic device 2701. The electronic device 2701 may include at least one of the aforementioned elements. Some of the elements may be omitted, or additional other elements may be further included. In addition, some of the elements of the electronic device 2701 may be combined and constructed as one entity, so as to equally perform functions of corresponding elements before combination.

At least some parts of a device (e.g., modules or functions thereof) or method (e.g., operations) may be implemented with an instruction stored in a computer-readable storage media for example. The instruction may be executed by the processor 2710, to perform a function corresponding to the instruction.

The computer-readable storage media may be, for example, the memory 2730.

At least some parts of the programming module may be implemented (e.g., executed), for example, by the processor 2710. At least some parts of the programming module may include modules, programs, routines, sets of instructions, processes, and the like, for performing one or more functions.

While the present disclosure has been particularly shown and described with reference to certain embodiments thereof, it will be understood by those of ordinary skill in the art that various changes in form and details may be made therein without departing from the spirit and scope of the present disclosure as defined by the following claims and their equivalents.

What is claimed is:

1. A portable electronic device comprising:

a front cover forming a front face of the electronic device;

a back cover forming a rear face of the electronic device;

a conductive sidewall at least partially surrounding a space formed between the front cover and the back cover;

a first portion that is integrally formed with the conductive sidewall and extends in a first direction parallel to the front cover of the portable electronic device;

a second portion that is integrally formed with the first portion and extends in a second direction substantially perpendicular to the first direction, a conductive structure located within the space and extending from the conductive sidewall, wherein the conductive structure includes a first surface directed toward the front cover and a second surface directed toward the back cover;

a non-conductive structure located within the space and contacting the conductive structure, wherein the non-conductive structure includes a first surface directed toward the front cover and a second surface directed toward the back cover;

an antenna pattern electrically connected to the conductive structure, the antenna pattern being distinct from the conductive structure; and a flexible conductive connector electrically connected to the conductive structure and the antenna pattern, wherein the antenna pattern extends on a portion of the first surface of the conductive structure and on a portion of the first surface of the non-conductive structure, or extends on a portion of the second surface of the conductive structure and on a portion of the second surface of the non-conductive structure.

2. The portable electronic device of claim 1, further comprising:

a display device located in the space formed by the conductive sidewall and includes a screen area exposed through the front cover; and an integrated circuit (IC) chip electrically connected to the flexible conductive connector.

3. The portable electronic device of claim 1, wherein the flexible conductive connector and the conductive sidewall include a first material.

4. The portable electronic device of claim 1, wherein the antenna pattern extends on a portion of the second surface of the conductive structure and on a portion of the second surface of the non-conductive structure, and wherein the flexible conductive connector electrically contacts a portion of the first surface of the conductive structure.

5. The portable electronic device of claim 4, wherein the antenna pattern extends on a portion of the first surface of the conductive structure and on a portion of the first surface of the non-conductive structure, and wherein the flexible conductive connector electrically contacts another portion of the first surface of the conductive structure or a portion of the antenna pattern.

6. The portable electronic device of claim 1, wherein the non-conductive structure includes a via hole formed therein, and wherein the conductive structure includes a first part that fills the via hole and extends in a direction perpendicular to the front cover of the portable electronic device.

7. The portable electronic device of claim 6, wherein the conductive structure further includes a second part that is integrally formed with the first part.

8. The portable electronic device of claim 7, wherein the conductive structure further includes a third part that is integrally formed with the second part.

9. The portable electronic device of claim 8, wherein the flexible conductive connector electrically contacts the third part.

10. The portable electronic device of claim 6, wherein the flexible conductive connector electrically contacts the first part.

11. The portable electronic device of claim 1, wherein the flexible conductive connector electrically contacts the second portion.

12. The portable electronic device of claim 1, wherein the non-conductive structure includes a polymer material.

13. A portable electronic device comprising:

a front cover forming a front face of the electronic device;

a back cover forming a rear face of the electronic device;

a conductive sidewall at least partially surrounding a space formed between the front cover and the back cover;

a first conductive structure located in the space and extending from the conductive sidewall, wherein the first conductive structure includes a first surface directed toward the front cover and a second surface directed toward the back cover;

a non-conductive structure located in the space and contacting the first conductive structure, wherein the non-conductive structure includes a first surface directed toward the front of the portable electronic device and a second surface directed toward the back of the portable electronic device, and wherein the non-conductive structure includes a via hole formed therethrough from the first surface to the second surface;

a second conductive structure including a part that passes through the via hole, a first surface directed toward the front of the portable electronic device, and a second surface directed toward the back of the portable electronic device;

an antenna pattern electrically connected to the second conductive structure, the antenna pattern being electrically distinct from the second conductive structure; and a flexible conductive connector electrically connected to the second conductive structure and the antenna pattern, wherein the antenna pattern extends on a portion of the first surface of the second conductive structure and on a portion of the first surface of the non-conductive structure, or extends on a portion of the second surface of the second conductive structure and on a portion of the second surface of the non-conductive structure.

14. The portable electronic device of claim 13, further comprising:

a display device located in the space formed by the conductive sidewall and includes a screen area exposed through the front cover; and an integrated circuit (IC) chip electrically connected to the flexible conductive connector.

15. The portable electronic device of claim 13, wherein the antenna pattern extends on a portion of the second surface of the second conductive structure and on a portion of the second surface of the non-conductive structure, and wherein the flexible conductive connector electrically contacts the first surface of the second conductive structure.

16. The portable electronic device of claim 15, wherein the antenna pattern further extends to a portion of the second surface of the first conductive structure.

17. The portable electronic device of claim 15, further comprising:

another antenna pattern that extends on a portion of the first surface of the second conductive structure and electrically contacts a part of the non-conductive structure, wherein the flexible conductive connector electrically contacts the first surface of the second conductive structure.

18. The portable electronic device of claim 17, wherein the antenna pattern further extends to a portion of the first surface of the first conductive structure.

19. The portable electronic device of claim 13, wherein the first conductive structure further includes a protrusion that extends from the first surface in a first direction perpendicular to the front of portable electronic device.

* * * * *